US005945267A

United States Patent [19]

Yabuuchi

[11] Patent Number: 5,945,267

[45] Date of Patent: Aug. 31, 1999

[54] SILVER HALIDE COLOR PHOTOGRAPHIC LIGHT SENSITIVE MATERIAL

[75] Inventor: Katsuya Yabuuchi, Hino, Japan

[73] Assignee: Konica Corporation, Japan

[21] Appl. No.: 08/886,918

[22] Filed: Jul. 2, 1997

[30] Foreign Application Priority Data

Jul. 4, 1996 [JP] Japan ..... 8-174766

[51] Int. Cl.[6] ..... G03C 1/08; G03C 7/26; G03C 7/32

[52] U.S. Cl. ..... 430/544; 430/543; 430/554; 430/555; 430/551; 430/567; 430/546

[58] Field of Search ..... 430/543, 554, 430/555, 551, 567, 544–546

[56] References Cited

U.S. PATENT DOCUMENTS 4,917,994 4/1990 Martinez et al. ..... 430/543

4,983,507 1/1991 Takahashi et al. ..... 430/551

5,376,521 12/1994 Inoue et al. ..... 430/567

*Primary Examiner*—Geraldine Letscher

*Attorney, Agent, or Firm*—Jordan B. Bierman; Bierman, Muserlian and Lucas

[57] ABSTRACT

A silver halide color photographic light sensitive material is disclosed, comprising a support having thereon photographic component layers, at least one of the component layers containing a coupler represented by the following formula, and the photographic material having an overall silver potential of 50 to 120 mV.

10 Claims, No Drawings

SILVER HALIDE COLOR PHOTOGRAPHIC LIGHT SENSITIVE MATERIAL

FIELD OF THE INVENTION

The present invention relates to a silver halide color photographic light sensitive material.

BACKGROUND OF THE INVENTION

Recently, there is strong demand for better photographic performance of silver halide color photographic light sensitive materials, leading to high level requirements for photographic characteristics such as sensitivity, fog and graininess, and storage stability.

With the proliferation of compact zoom cameras and film incorporating cameras, small format employing advanced photo systems and an increase of photographic demands by amateurs, enhancement of the above photographic performance has become indispensable for silver halide photographic materials.

Particularly with regard to the storage stability, when stored in a dresser and even before expiration date, the magenta coupler is subject to deterioration by harmful gases such as formaldehyde, resulting in so-called magenta-faded negatives which result in greenish prints.

There have been a number of studies of two-equivalent magenta couplers to solve these problems, as described in JP-B 60-40016 (the term, JP-B refers to examined and published Japanese Patent). Further, JP-A 59-229557 also discloses specific two-equivalent magenta couplers. These two-equivalent couplers are so highly color-formable that high density portions become grain-less (flatness) due to overlapping of formed dye-clouds, resulting in excellent graininess. On the other hand, fogged-portions (Dmin.) or low-exposed and low-density portions deteriorate with respect to fog and graininess. Therefore, a technical means for satisfying all of these shortcomings is desired.

SUMMARY OF THE INVENTION

It is an object of the present invention to provide a silver halide photographic light sensitive material with high sensitivity and low fog and superiority in graininess and storage stability (formaldehyde resistance).

The objective of the present invention can be accomplished by the following constitution:

A silver halide color photographic light sensitive material comprising a support having thereon photographic component layers including a silver halide emulsion layer, at least one of the component layers containing a coupler represented by the following formula (1), the photographic material having an overall silver potential (EAg) of 50 to 120 mV:

formula (1)

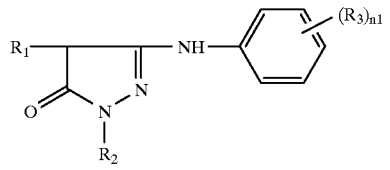

wherein $R_1$ represents a hydrogen atom or a coupling-off group capable of being released upon reaction with an oxidation product of a primary aromatic amine developing agent; $R_2$ represents an aryl group; $R_3$ represents a substituent; n is an integer of 1 to 5, provided that when n is 2 or more, $R_3$ may be the same or different from each other.

DETAILED DESCRIPTION OF THE INVENTION

The coupler represented by formula (1) will be described further in detail. In formula (1), $R_1$ represents a hydrogen atom or a coupling-off group capable of being released upon reaction with an oxidation product of a primary aromatic amine developing agent. Thus, in the case $R_1$ being not a hydrogen atom, $R_1$ is preferably a substituted thioaryl group and more preferably thiophenyl group with a ballast group. $R_2$ represents an aryl group and preferably a phenyl group substituted by a halogen atom, alkoxy group, cyano group, substituted sulfon group or acylamino group. $R_3$ represents a substituent. Examples thereof include a hologen atom such as chlorine, bromine or iodine; an alkoxy group such as methoxy or ethoxy; an aryloxy group such as phenoxy; a benzoylamino group such as 2,6-dichlorobenzoylamino or 2,6-dimethoxy-benzoylamino; an acylamino group such as acetylamino; a sulfonyl group such as alkylsufonyl; a sulfamoyl group; a sulfonamido group, an alkoxycarbonyl group; cyano group, nitro group, carboxyl group, amino group, and an alkyl group such as methyl, ethyl or propyl. $n_1$ is an integer of 1 to 5, and when $n_1$ is 2 or more, $R_3$ may be the same or different from each other and at least one of $R_3$ is preferably a halogen atom or an alkoxy group, more preferably a halogen atom.

Exemplary examples of the coupler are shown below.

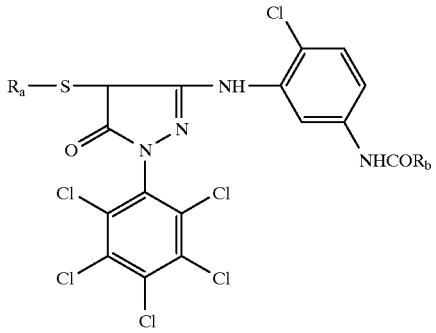
| No. | $R_a$ | $R_b$ |
|---|---|---|
| 1-1 | 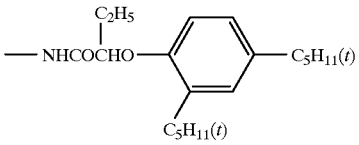 | 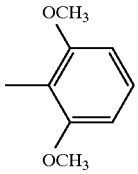 |
| 1-2 | 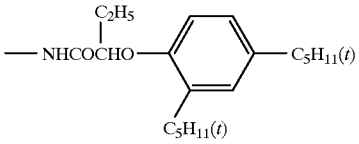 | 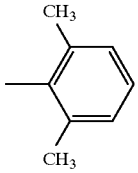 |
| 1-3 | 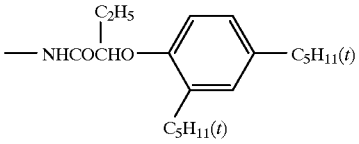 | 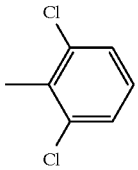 |
| 1-4 | 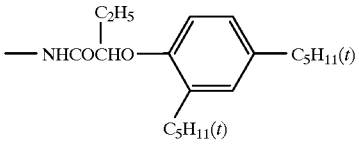 | 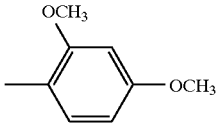 |
| 1-5 | 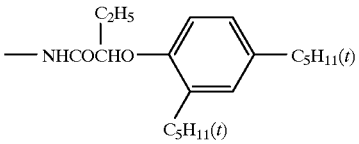 | 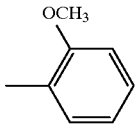 |
| 1-6 | 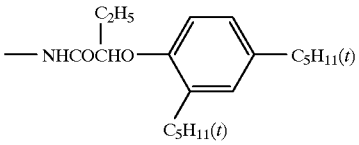 | 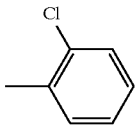 |

-continued
| | | |
|---|---|---|
| 1-7 | 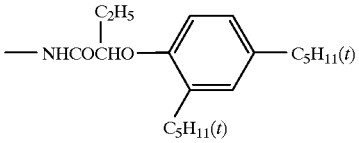 | 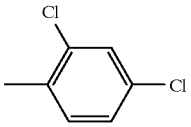 |
| 1-8 | 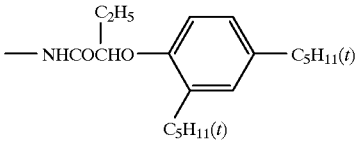 | 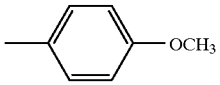 |
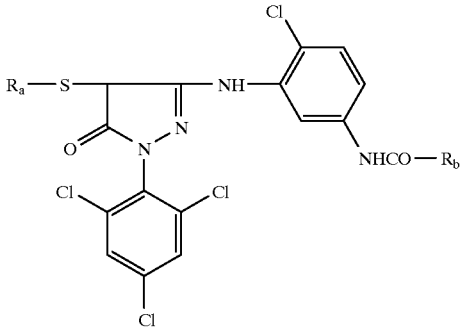
| No. | $R_a$ | $R_b$ |
|---|---|---|
| 1-9 | 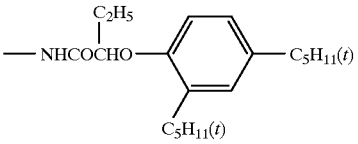 | 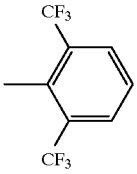 |
| 1-10 | 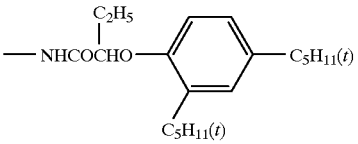 | 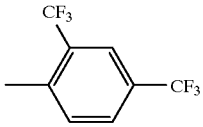 |
| 1-11 | 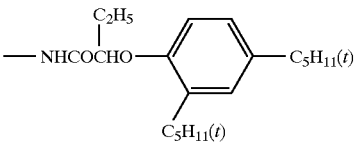 | 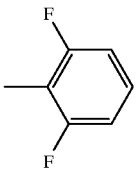 |
| 1-12 | 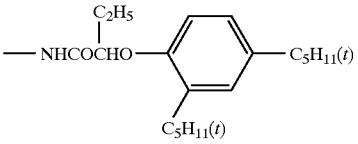 | 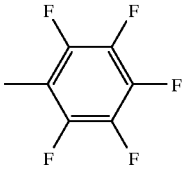 |

-continued
| | | |
|---|---|---|
| 1-13 | 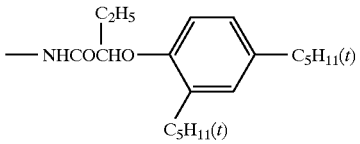 | 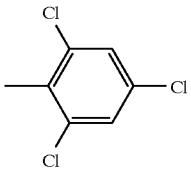 |
| 1-14 | 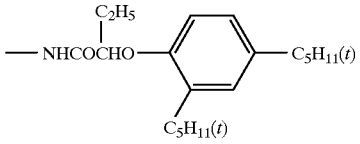 | 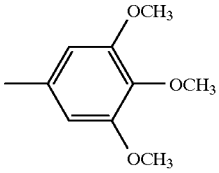 |
| 1-15 | 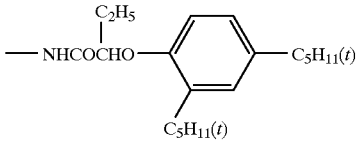 | 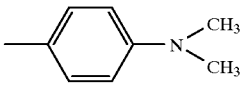 |
| 1-16 | 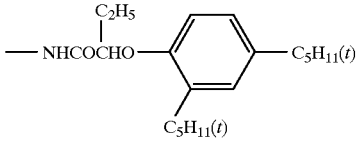 | 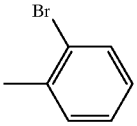 |
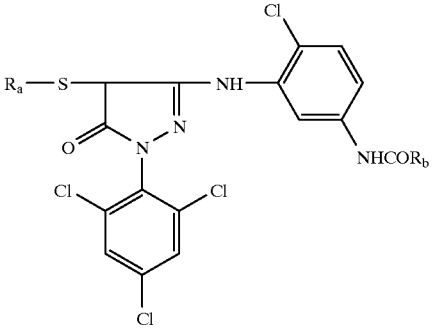
| No. | $R_a$ | $R_b$ |
|---|---|---|
| 1-17 | 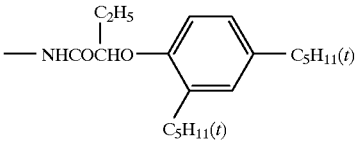 | 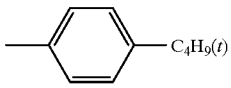 |
| 1-18 | 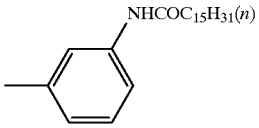 | 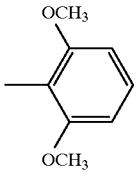 |
| 1-19 | 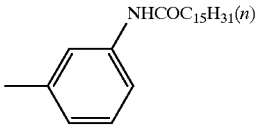 | 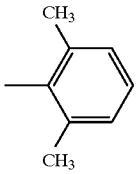 |

-continued
1-20
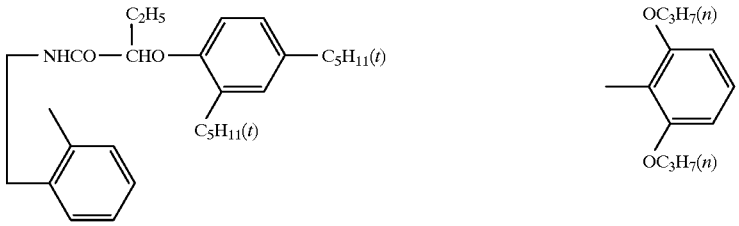
1-21
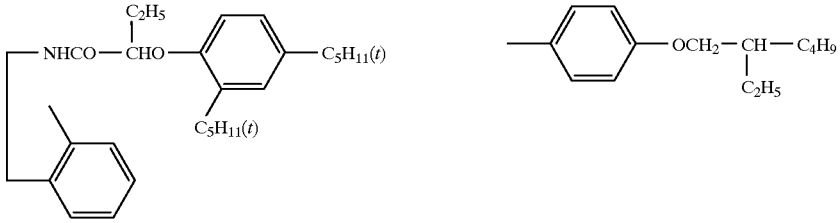
1-22
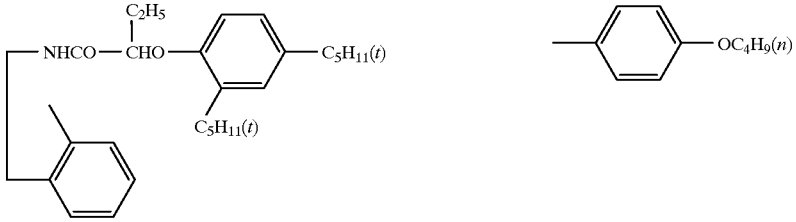
1-23
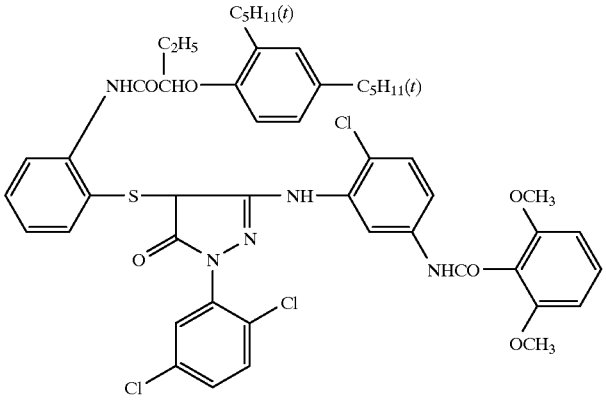
1-24
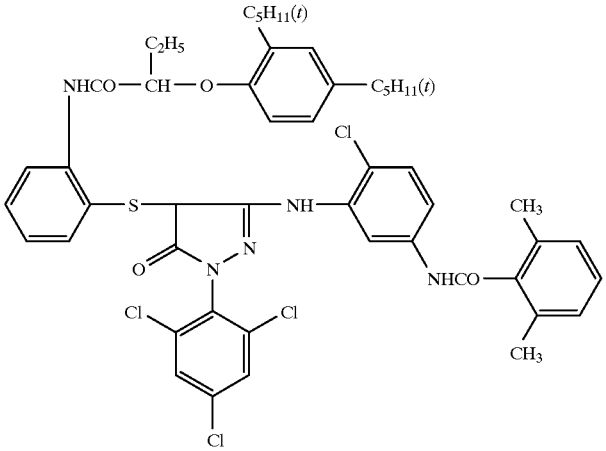

-continued
1-25
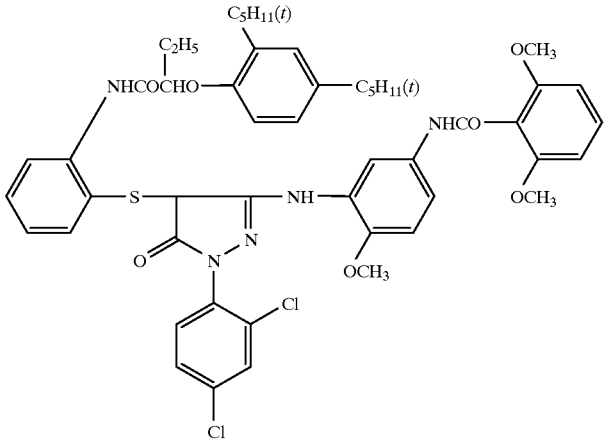
1-26
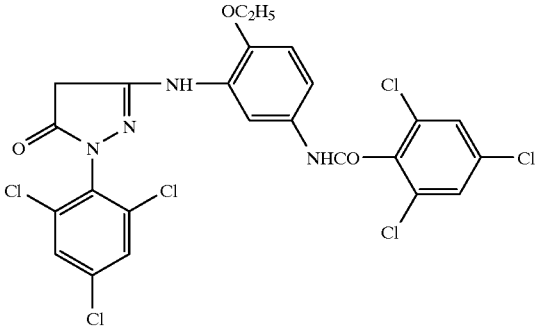
1-27
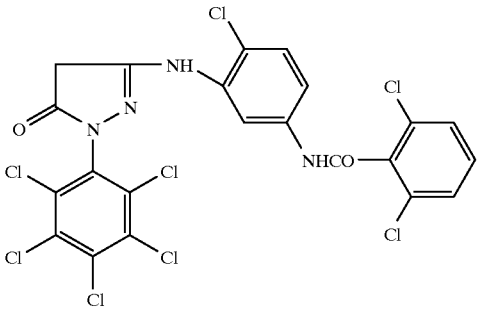
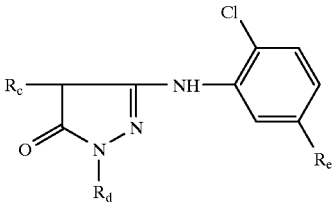
| No. | $R_c$ | $R_d$ | $R_e$ |
|---|---|---|---|
| 1-28 | 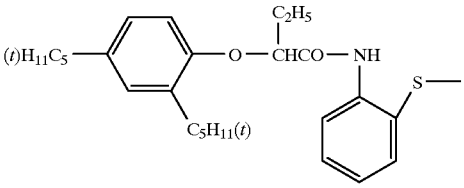 | 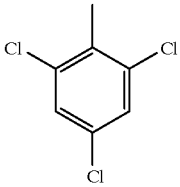 | —NHCOC$_{13}$H$_{27}$(n) |

-continued
1-29
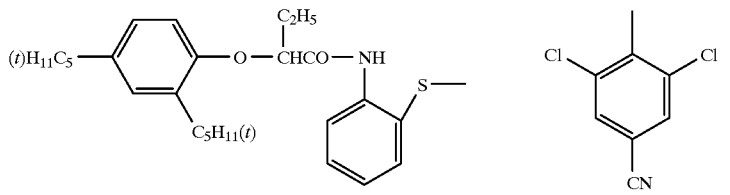
—$NHCOC_{13}H_{27}(n)$
1-30
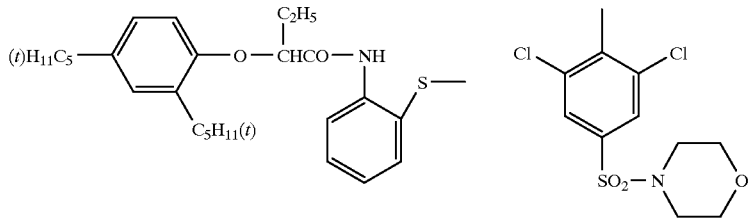
—$NHCOC_{13}H_{27}(n)$
1-31
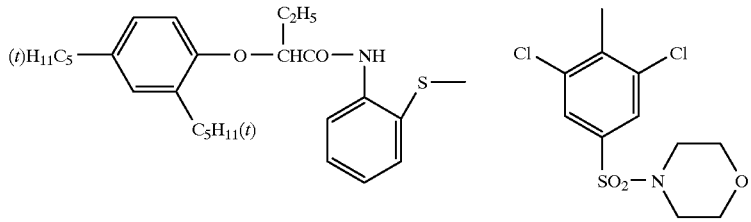
—$SO_2C_{12}H_{25}(n)$
1-32
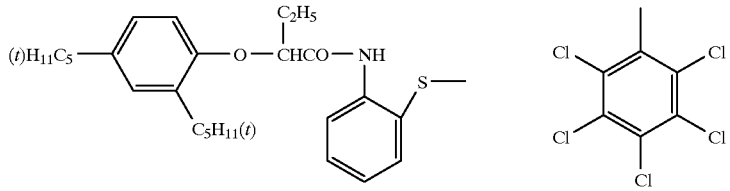
—$SO_2C_{12}H_{25}(n)$
1-33
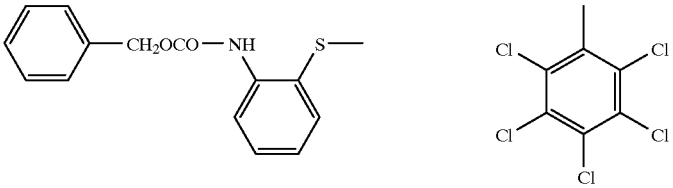
—$NHCOC_{15}H_{31}(n)$
1-34
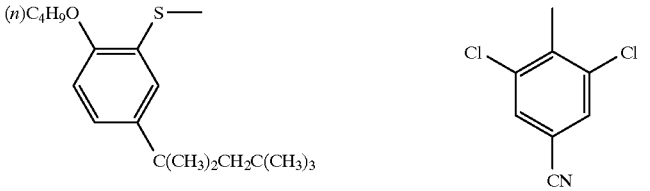
—$NHCOC_{13}H_{27}(n)$
1-35
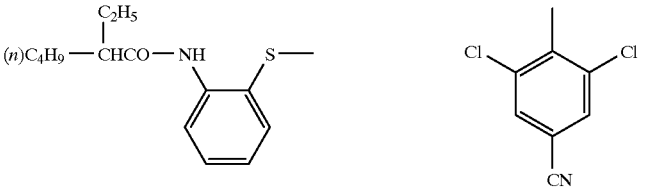
—$SO_2NHC_{18}H_{37}(n)$ -continued
| | | | |
|---|---|---|---|
| 1-36 | 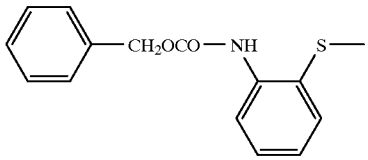 | 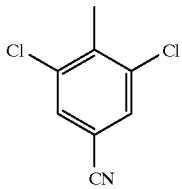 | $—SO_2C_{16}H_{33}(n)$ |
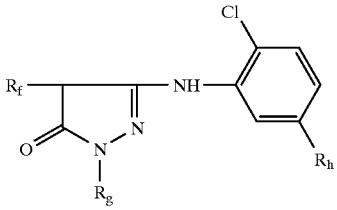
| No. | $R_f$ | $R_g$ | $R_h$ |
|---|---|---|---|
| 1-37 | 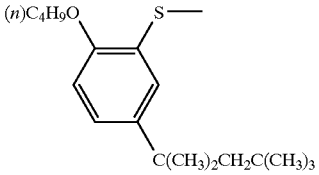 | 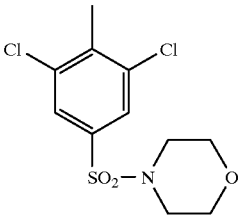 | $—SO_2NHC_{12}H_{25}(n)$ |
| 1-38 | 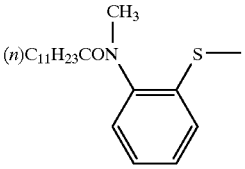 | 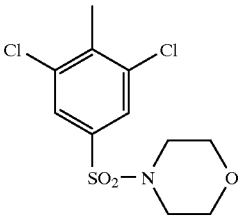 | $—SO_2NHC_{12}H_{25}(n)$ |
| 1-39 | 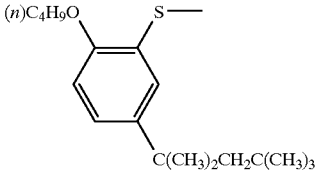 | 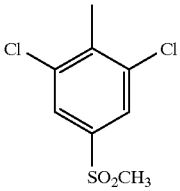 | $—CO_2C_{12}H_{25}(n)$ |
| 1-40 | 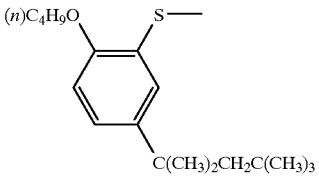 | 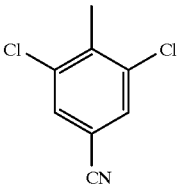 | $—CO_2C_{12}H_{25}(n)$ |
| 1-41 | 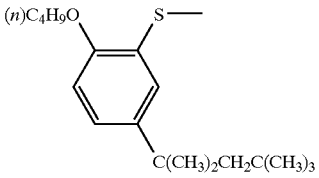 | 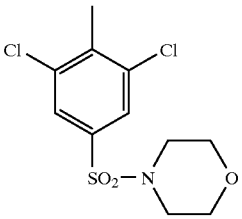 | $—NHCOC_{13}H_{27}(n)$ |

-continued

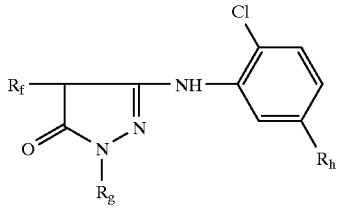

| No. | $R_f$ | $R_g$ | $R_h$ |
|---|---|---|---|
| 1-42 | 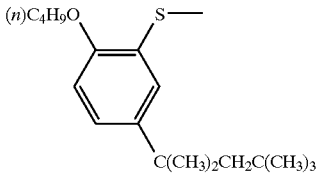 | 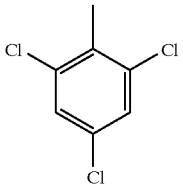 | $—SO_2C_{12}H_{25}(n)$ |
| 1-43 | 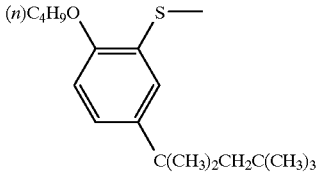 | 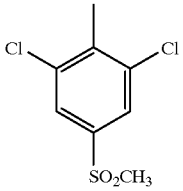 | $—SO_2C_{12}H_{25}(n)$ |
| 1-44 | 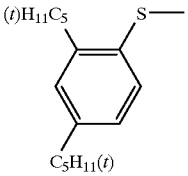 | 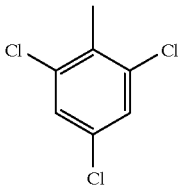 | $—SO_2NHC_{12}H_{25}(n)$ |
| 1-45 | 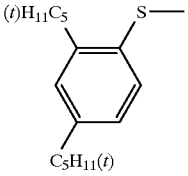 | 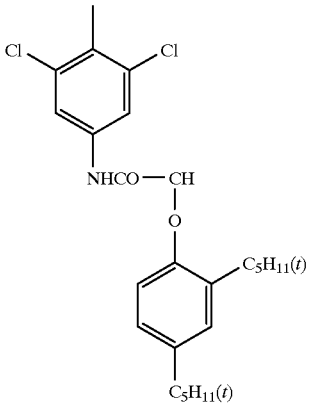 | $—SO_2CH_3$ |

The coupler can be employed singly or in combination. The coupler can be employed in combination with a coupler other than the above-described coupler. In this case, the coupler can be employed in an amount of not less than 30 mol %, preferably not less than 50 mol % and more preferably not less than 80 mol % of the total coupler contained in the same layer.

The coupler is preferably contained in s green sensitive silver halide emulsion layer. In cases where the green-sensitive layer is comprised of plural layers, the coupler may be contained in only one layer, but to achieve effects of the invention, the coupler is contained in all of the green-sensitive layers.

In the invention, a compound represented by the following formula (5) is preferably contained to effectively achieve the object of the invention.

Formula (5)

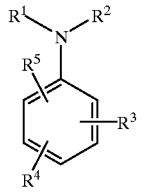

wherein $R^1$ and $R^2$ each represent a hydrogen atom, an alkyl group, alkenyl group, alkynyl group, aryl group or heterocyclic group; and $R^3$, $R^4$ and $R^5$ each represents a substituent, provided that $R^1$ and $R^2$, $R^3$ and R4, or $R^4$ and $R^5$ may combine with each other to form a ring.

Examples of the substituent represented by $R^1$ and $R^2$ include a hydrogen atom, an alkyl group (e.g., methyl, ethyl, n-propyl, iso-propyl, tert-butyl, n-pentyl, cyclopentyl, n-hexyl, cyclohexyl, n-octyl, n-dodecyl, etc.), an alkenyl group (e.g., vinyl, allyl, etc.), an alkynyl (e.g., propargyl, etc.), an aryl group (e.g., phenyl, naphthyl, etc.), and a heterocyclic group (e.g., pyridyl, pyrimidyl, oxazolyl, thiazolyl, imidazolyl, furyl, prolyl, pyrazinyl, pyrimidinyl, pyridazinyl, selenazolyl, sulforanyl, piperidinyl, pyrazolyl, tetrazolyl, etc.). These substituent may be further substituted.

Examples of the substituent represented by $R^3$, $R^4$ and $R^5$ include an alkyl group (e.g., methyl, ethyl, n-propyl, iso-propyl, tert-butyl, n-pentyl, cyclopentyl, n-hexyl, cyclohexyl, n-octyl, n-dodecyl, etc.), an alkenyl group (e.g., vinyl, allyl, etc.), an alkynyl (e.g., propargyl, etc.), an aryl group (e.g., phenyl, naphthyl, etc.), a heterocyclic group (e.g., pyridyl, pyrimidyl, oxazolyl, thiazolyl, imidazolyl, furyl, prolyl, pyrazinyl, pyrimidinyl, pyridazinyl, selenazolyl, sulforanyl, piperidinyl, pyrazolyl, tetrazolyl, etc.), a halogen atom (e.g., chlorine atom, bromine atom, iodine atom, fluorine atom etc.), an alkoxy group (e.g., methoxy, ethoxy, propyloxy, n-pentyloxy, cyclopentyloxy, n-hexyloxy, cyclohexyloxy, n-octyloxy, n-dodecyloxy, etc.), an aryloxy group (e.g., phenoxy, naphthyloxy, etc.,), an alkoxycarbonyl group (e.g., methyloxycarbonyl, ethyloxycarbonyl, n-butyloxycarbonyl, n-octyloxycarbonyl, n-dodecyloxycarbonyl, etc.), an aryloxycarbonyl group (e.g., phenyloxycarbonyl, naphthyloxycarbonyl, etc.), a sulfonamido group (e.g., methylsulfonylamino, ethylsulfonylamino, n-butyl-sulfonylamino, n-hexylsulfonylamino, cyclohexylsulfonylamino, n-octylsulfonylamino, n-dodecysulfonylamino, phenylsulfonylamino, etc.), a sulfamoyl group (e.g., amionosulfonyl, methylaminosulfonyl, dimethylaminosulfonyl, n-butylamino-sulfonyl, n-hexylaminosulfonyl, cyclohexylaminosulfonyl, n-octylaminosulfonyl, n-dodecylaminosulfonyl, phenylaminosulfonyl, naphthylaminosulfonyl, 2-pyridylaminosulfonyl, etc.), a ureido group (e.g., methylureido, ethylureido, pentylureido, cyclohexylureido, n-octylureido, n-dodecylureido, phenylureido, 2-pyridylaminoureido, etc.), an acyl group (e.g., acetyl, ethylcarbonyl, propylcarbonyl, n-pentylcarbonyl, cyclohexylcarbonyl, n-octylcarbonyl, 2-ethylhexylcarbonyl, n-dodecylcarbonyl, phenylcarbonyl, naphthylcarbonyl, pyridylcarbonyl, etc.), a carbamoyl group (e.g., aminocarbonyl, methylaminocarbonyl, dimethylaminocarbonyl, propylaminocarbonyl, n-pentylaminocarbonyl, cyclohexylaminocarbonyl, n-dodecylaminocarbonyl, phenylaminocarbonyl, naphthylaminocarbonyl, 2-pyridylaminocarbonyl, etc.), an amido group (e.g., acetoamido, ethylcarbonylamino, propylcarbonylamino, n-pentylcarbonylamino, cyclohexylcarbonylamino, 2-ethylhexylcarbonylamino, n-octylcarbonylamino, dodecylcarbonylamino, benzoylamino, naphthylcarbonylamino, etc.), a sulfonyl group (e.g., methylsulfonyl, ethylsulfonyl, n-butylsulfonyl, cyclohexylsulfonyl 2-ethylhexylsulfonyl, dodecylsulfonyl, phenylsulfonyl, naphthylsulfonyl, 2-pyridylsulfonyl, etc.), an amino group (e.g., amino, ethylamino, dimethylamino, n-butylamino, cyclopentylamino, 2-ethylhexylamino, n-dodecyamino, anilino, naphthylamino, 2-pyridylamino, etc.), a cyano group, a nitro group, a carboxyl group, a hydroxy group, a sulfo group and a hydrogen atom. These groups may be substituted by the same substituent as the alkyl group represented by $R^1$ and $R^2$ or the substituent of the alkyl group.

Examples of the ring formed by combination of $R^1$ and $R^2$ include a piperidine ring, pyrrolidine ring, morpholine ring, pyrrole ring, piperazine ring, and thiomorpholine ring. Examples of the ring formed by combination of $R^3$ and $R^4$, or $R^4$ and $R^5$ include a benzene ring, thiophene ring, furan ring and pyrrole ring.

Exemplary examples of the compound represented by formula (5) are shown below, but the compound is not limited these examples.

5-1

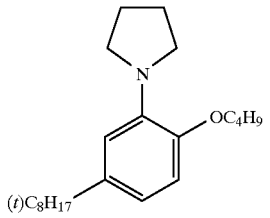

5-2

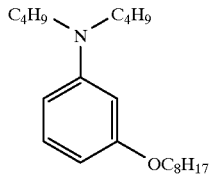

5-3

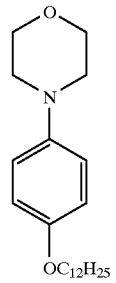

-continued 5-4

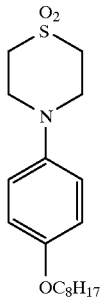

5-5

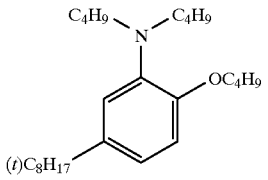

5-6

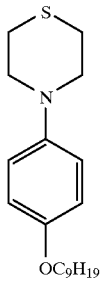

5-7

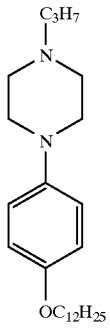

5-8

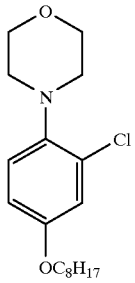

-continued 5-9

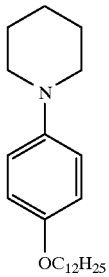

5-10

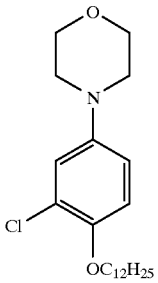

5-11

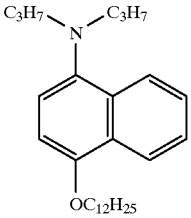

The compound represented by formula which is preferably employed in the invention is preferably contained in an amount of 1 to 300% and more preferably 5 to 150% by weight, based on the coupler represented by formula (1). The compound may be incorporated in the same layer as one containing the coupler, or in a different layer. The compound is preferably contained in the same layer. The compound can be incorporated in a photographic material by various dispersing methods employed in couplers. Thus, the compound can be incorporated through dispersing along with or separately from the coupler. The compound preferably is simultaneously dispersed with the coupler.

A silver halide emulsion known in the art can be applicable as a silver halide emulsion used in the component layers of the photographic material according to the , and a silver halide emulsion containing tabular grains is preferably used. More preferably used is a silver halide emulsion containing tabular grains with an aspect ration of 1.5 or more (furthermore preferably, 3 or more) which accounts for at least 50% of the total grain projected area.

The tabular silver halide grains are crystallographically classified into a twinned crystal. The twinned crystal refers to the crystal having one or more twin planes within the crystal. Configuration classification of the twinned crystal is detailed in Klein & Moisar, Photographishe Korrepondenz, Vol.99, page 99 and ibid Vol.100, page 57. The tabular silver halide grains used in the invention are those having one twin plane or not less than two, parallel twin planes. To reduce fluctuation of surface areas between grains, tabular grains having two parallel twin planes are preferred.

The aspect ratio refers to a ratio of a grain diameter to a grain thickness (i.e., aspect ratio=diameter/thickness). When a face with a maximum area among faces constituting the tabular grain surface (so-called, major face) is projected vertically to the face, the diameter refers to one of a circle having the same area of the projected area of the major face, which is also referred to as a projected area diameter. The grain thickness refers to a thickness in the vertical direction to the major face and generally coincides with a distance between two major faces.

The average aspect ratio according to the invention is an arithmetic mean value of aspect ratios of 500 grains which are randomly selected from silver halide grains contained in the emulsion.

The grain size and thickness can be determined in accordance with the following method. There is prepared a sample in which silver halide grains are coated on a support so that the major face of the silver halide grains are oriented in parallel to that of latex balls used as internal standard and having a known diameter. After being subjected to shadowing from a give angle by a carbon evaporating method, a replica sample is prepared by a conventional replica method. Electronmicrograph of the sample is taken and the projected area and thickness of each grain can be determined using a device such as an image processor. In this case, the projected area of the grain can be determined from that of the internal standard, and the thickness of the grain can be determined from shadow lengths of the internal standard and the grain.

With regard to halide composition of silver halide grains used in the invention are preferably silver iodobromide and silver iodochlorobromide, and more preferably silver iodobromide. The halide composition of the grains can be determined by a composition analysis, such as EPMA method and X ray diffractometry.

The silver halide grains used in the invention preferably have dislocation lines with the grains. The site of the dislocation lines being present is especially non-limitative. The dislocation lines are present preferably in the vicinity of the outer periphery, in the vicinity of the edge or in the vicinity of the corner of the tabular silver halide grains. As to the time of introducing the dislocation lines into the grain, it is preferred to introduce the dislocation line after 50% of the overall silver amount of the grains is introduced, more preferably during 60 to 95% and furthermore preferably, during 70 to 90%. As to the number of the dislocation lines, grains having 5 or more dislocation lines preferably account for 50% or more, more preferably 70% or more and furthermore preferably 90% or more of the total grain projected area. In each case, the number of the dislocation lines is more preferably 10 or more.

The dislocation lines in the silver halide grains can be directly observed by means of transmission electron microscopy at a low temperature, for example, in accordance with a method described in J. F. Hamilton, Photo. Sci. Eng. vol.11 (1967) 57 and T. Shiozawa, Journal of the Society of Photographic Science and Technology of Japan, vol.35 (1972) 213. Tabular silver halide grains are taken out from a silver halide emulsion while making sure not to exert any pressure that causes dislocation in the grain, and they are place on a mesh for electron microscopy. The sample is observed by transmission electron microscopy, while being cooled to prevent the grain from being damaged (e.g., printed-out) by electron beam. Since electron beam penetration is hampered as the grain thickness increases, sharper observations are obtained when using an electron microscope of high voltage type (e.g., over 200 KV for 0.25 μm thick grains). From the thus-obtained electronmicrograph, the position and number of the dislocation lines in each grain can be determined in the case when being viewed from the direction perpendicular to the major face.

The average size of the silver halide grains used in the invention is preferably 0.1 to 1.2 and more preferably 0.2 to 1.0 μm. In the case of less than 0.1 μm, sufficiently high sensitivity for practical use can not be achieved. In the case of more than 1.2 μm, on the other hand, deterioration of graininess is marked. The grain size according to the invention refers to an edge length of cube having a volume identical to the volume of a silver halide grain. The average grain size is an arithmetic mean of 500 grains which are randomly selected from silver halide grains contained in an emulsion.

One of the component layers of the photographic material according to the invention preferably contains a polymeric compound with a number-averaged molecular weight of 500 to 20,000 and having a repeating unit represented by the following formula (2):

Formula (2)

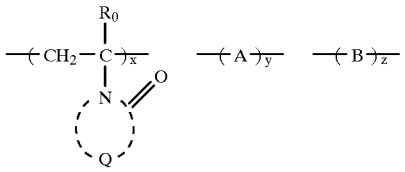

wherein $R_0$ represents a hydrogen atom or an alkyl group; Q represents a nonmetallic atom group necessary for forming a 5 to 7 membered ring containing N and C═O; A and B each represent a copolymerizable, ethylenic unsaturated compound; x, y and z are each represented in terms of mol %, and $10 \leqq x \leqq 100$, $0 \leqq y \leqq 90$ and $0 \leqq z \leqq 90$.

In the invention, the component layer containing the coupler represented by formula (1) preferably further contains a polymeric compound having a numberer-averaged molecular weight of not less than 500 and less than 20,000, and having a repeating unit represented by the following formula (2):

Formula (2)

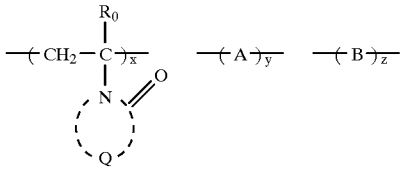

wherein $R_0$ represents a hydrogen atom or an alkyl group; Q represents a nonmetallic atom group necessary for forming a 5 to 7-membered ring including —N— and >C═O; A and B each represent a ethylenic unsaturated compound which is copolymerizable; x, y and z each are represented in terms of mol %, $10 \leqq x \leqq 100$, $0 \leqq y \leqq 90$ and $0 \leqq z \leqq 90$.

The ethylenic unsaturated compound include acrylic acid esters, methacrylic acid esters, acrylamides, methacrylamide, allyl compounds, vinyl ethers, vinyl esters, vinyl heterocyclic compounds, styrenes, maleic acid esters, fumaric acid esters, itaconic acid esters, crotonic acid esters and olefins. Exemplary examples thereof include methyl acrylate, ethyl acrylate, isopropyl acrylate, n-butyl acrylate, octyl acrylate, 2-chloroethyl acrylate, 2-cyanoethyl acrylate, N-(β-dimethylaminoethyl)acrylate, benzyl acrylate, cyclohexyl acrylate, phenyl acrylate; methyl methacrylate, n-propyl methacrylate, isopropyl methacrylate, n-butyl methacrylate, cyclohexyl methacrylate, 3-sulfopropyl methacrylate; allyl butyl ether and allyl phenyl ether, methyl vinyl ether, butyl vinyl ether; methoxyethyl vinyl ether, 2-hydroxyethyl vinyl ether, (2-dimethylaminoether)vinyl ether, vinyl phenyl ether, vinyl chlorophenyl ether; acrylamide, methacrylamide, N-methylacrylamide, N-(1,1-dimethyl-3-oxobutyl)acrylamide, N-(1,1-dimethyl-3-hydroxybutyl)acrylamide, N,N-dimethylacrylamide, acryloyl hydrazine, N-methoxymethyl methacrylate, N-(1,1-dimethyl-3-hydroxybutyl)methacrylate, N-hydroxymethylacrylamide; vinyl pyridine, N-vinylimidazole, N-vinylcarbazole, vinyl thiophene; styrene, chloromethylstyrene, p-acetoxystyrene, p-methylstyrene; p-vinylbenzoic acid, methyl p-vinylbenzoate; crotoamide, butyl crotonate, glycerol monocrotonate; methyl vinyl ketone, phenyl vinyl ketone; ethylene, propylene, 1-butene, dicyclopentadiene, 4-methyl-1-hexene, 4,4-dimethyl-1-pentene; methyl itaconate, ethyl itaconate, diethyl itaconate; methyl sorbate, ethyl maleate, butyl maleate, dibutyl maleate, octyl maleate, ethyl fumarate, dibutyl fumarate, octyl fumarate; halogenated olefins such as vinyl chloride, vinilidene chloride and isoprene; acrylonitrile, and methacrylonitrile.

Examples of the polymeric compound represented by formula (29 are shown below, but the compound is not limited to these examples.

P-1: Poly(N-vinylpyrrolidone)
P-2: N-vinylpyrrolidone-vinyl alcohol copolymer (80:20)
P-3: N-vinylpyrrolidone-vinyl alcohol copolymer (70:30)
P-4: N-vinylpyrrolidone-vinyl acetate copolymer (70:30)
P-5: N-vinylpyrrolidone-vinyl acrylamide copolymer (90:10)
P-6: N-vinylpyrrolidone-2-hydroxyethyl acrylate copolymer (70:30)
P-7: N-vinylpyrrolidone-acrylamide copolymer (80:20)
P-8: N-vinylpyrrolidone-acrylamide copolymer (60:40)
P-9: N-vinylpyrrolidone-dimethylacrylamide copolymer (80:20)
P-10: N-vinyl pyrrolidone-vinyl acetoamide copolymer (70:30)
P-11: N-vinyl pyrrolidone-vinyl acetate-vinyl alcohol copolymer (60:30:10)
P-12: N-vinyl pyrrolidone-2-hydroxyethylacrylamide-vinyl acetate copolymer (70:20:10)
P-13: Poly(N-vinyl oxazolidone)
P-14: Poly(N-vinyl piperidone)
P-15: Poly(n-vinyl succinimide)
P-16: Poly(N-vinyl glutarimide)
P-17: N-vinyl pyrrolidone-2-methoxyethyl acrylate copolymer (70:30)
P-18: N-vinyl pyrrolidone-methyl vinyl ether copolymer (80:20)
P-19: N-vinylpyrrolidone-N-vinylpiperidone-2-hydroxyethylacrylate copolymer (50:30:20)
P-20: N-vinyl-ε-caprolactom-acrylamide copolymer (60:40)

A number-averaged molecular weight of the polymeric compound represented by formula (2) is preferably 1,000 to 9,000.

The polymeric compound is contained in an amount of not less than 0.1 g, more preferably not less than 1.0 g and furthermore preferably not less than 3.0 g per mol of silver halide. The use of 100 g or more is not preferred because of deteriorating sensitivity or physical properties of the layer.

According to the invention, it is preferred that the pH of the outermost surface of the emulsion-side of the photographic material be within 4.1 to 5.5.

The pH of the emulsion-side surface can be measured in the following manner. Thus, 20 ml of water is placed on the surface of the emulsion layer-side of a photographic material and a planar pH-electrode is brought into close contact with the surface to read the pH value. The planar pH-electrode is commercially available (e.g., GST-S213 type F, produced by TOA DENPA KOGYO Corp.).

The pH value of the surface can be adjusted by adding, to a coating solution, a solution of a base such as sodium hydroxide, potassium hydroxide, sodium carbonate, potassium citrate sodium acetate or potassium acetate, or a solution of an acid such as hydrochloric acid, sulfuric acid, acetic acid, formic acid, citric acid or boric acid.

The intended pH of the surface is attained preferably by adjusting the pH value of the coating solution of the component layer containing the coupler represented by formula (1). Alternatively, the pH adjustment may be performed in another component layer, in which diffusion during the coating and drying process is controlled, or in all coating solutions.

To achieve the advantageous effects of the invention, the pH of the outermost layer surface is preferably 5.5 or less and more preferably 5.2 or less. A pH of less than 4.0 markedly retards the cross-linking reaction of the hardening agent employed in the photographic material.

In cases where the cross-linking reaction is retarded, it is effective to employ a fast acting instant hardener, as described The photographic material according to the invention has an overall silver potential (hereinafter, denoted as EAg) of 50 to 120 mV. The overall EAg refers to that of overall layers coated on the emulsion-side. The overall EAg can be determined in the following manner. Initially, 500 $cm^2$ of the silver halide color photographic material according to the invention is cut into strips and dipped in 100 cc of water, and after being allowed to stand for 6hr. in a darkroom, the silver potential of the dipping solution is measured at a temperature of 20° C., using a silver electrode and a saturated silver-silver chloride electrode (used as a reference electrode). Thus, the photographic material accoding to the invention exhibits an overall EAg of 50 to 120 mV to the silver-silver chloride reference electrode. In cases when there is provided a layer such as a backing layer on the side opposite to the emulsion side, such a layer must be first removed.

The overall EAg value of the coating layers can be adjusted by controlling the EAg of coating solutions, adding an aqueous solution of $AgNO_3$, KBr, NaBr or KCl so as to attain the intended overall EAg value of the coating layers. The coating solution of which EAg is to be controlled so as to attain the intended overall EAg of the coating layers may be that of a layer containing the coupler represented by formula (1) or that of another component layer, in which the EAg is adjusted by diffusion during the process of coating and drying. Further, the overall EAg of the coating layers can be adjusted by controlling the EAg of all coating solutions. To achieve effects of the invention, the overall EAg is adjusted to not more than 120 mV and preferably not more than 100 mV. The EAg of less than 50 mV results in unpreferred reduction of sensitivity.

According to the invention, the component layer containing the coupler represented by formula (1) preferably contains further a compound represented by formula (3) in an amount of not less than $5.0\times10^{-4}$ mol per mol of silver halide layer:

Het-(SR)i Formula (3)

wherein Het represents a heterocyclic ring; R represents a hydrogen atom, alkyl group, alkenyl group, aryl group or heterocyclic group; and i is an integer of 0, 1 or 2.

Examples of the heterocyclic group represented by Het include a oxazole ring, imidazole ring, thiazole ring, triazole ring, selenazole ring, tetrazole ring, oxadiazole ring, thiadiazole ring, thiazine ring, triazine ring, benzoxazole ring, benzthiazole ring, benzimidazole ring, indolenine ring, benzselenazole ring, naphthothiazole ring, triazaindolizine ring, diazaindolizine ring and tetraazaindolizine.

The compound represented by formula (3) is preferably those represented by formula (3A) or (3B):

Formula (3A)

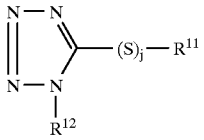

wherein $R^{11}$ and $R^{12}$ each represent a hydrogen atom, an alkyl group, alkenyl group, alkynyl group, aryl group or heterocyclic group; and J is an integer of 0 or 1;

Formula (3B)

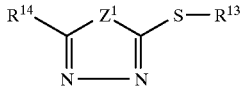

wherein $R^{13}$ represents a hydrogen atom, an alkyl group, alkenyl group, alkynyl group, aryl group or heterocyclic group; $R^{14}$ represents a substituent; $Z^1$ represents an oxygen atom, sulfur atom or —N($R^{15}$)—, in which $R^{15}$ represents a hydrogen atom, an alkyl group, alkenyl group, alkynyl group, aryl group, heterocyclic group or —N($R^{16}$)($R^{17}$), in which $R^{16}$ and $R^{17}$ each represent a hydrogen atom, alkyl group, alkenyl group, alkynyl group, aryl group or heterocyclic group.

In formulae (3), (3A) and (3B), examples of the alkyl group represented by $R^{10}$, $R^{11}$, $R^{12}$, $R^{13}$, $R^{14}$, $R^{15}$, $R^{16}$ or $R^{17}$ includes methyl, ethyl, propyl, i-propyl, butyl, t-butyl, pentyl, cyclopentyl, hexyl, cyclohexyl, octyl and dodecyl. The alkyl group may be substituted by a halogen atom (e.g., chlorine, bromine, iodine), an alkoxy group (e.g., methoxy, ethoxy, 1,1-dimethylethoxy, hexyloxy, dodecyloxy), aryloxy (e.g., phenoxy, naphthyloxy), aryl group (e.g., phenyl, naphthyl), alkoxycarbonyl group (e.g., methoxycarbonyl, ethoxycarbonyl, butoxycarbonyl, 2-ethylhexylcarbonyl), aryloxycarbonyl group (e.g., pheoxycarbonyl, naphthyloxycarbonyl, heterocyclic group (e.g., 2-pyridyl, 3-pyridyl, 4-pyridyl, morpholyl, piperidyl, piperazyl, selenazolyl, sulforanyl, piperidinyl, tetrazolyl, thiazolyl, oxazolyl, imidazolyl, thienyl, pyrrolyl, pyrazinyl, pyrimidinyl, pyridazinyl, pyrimidinyl, pyrazolyl, furyl), amino group (e.g., amino, N,N-dimethylamino, anilino), hydroxy group, cyano group, sulfo group, carboxy group, and sulfonamido group (e.g., methylsulfonylamino, ethylsulfonylamino, butylsulfonylamino, octylsulfonylamino, phenylsulfonylamino).

Examples of the alkenyl group represented by $R^{10}$, $R^{11}$, $R^{12}$, $R^{13}$, $R^{14}$, $R^{15}$, $R^{16}$ or $R^{17}$ vinyl or allyl; the alkenyl group includes propargyl; example of the aryl group include pheny or naphthyl; examples of the heterocyclic group include a pyridyl group e.g., 2-pyridyl, 3-pyridyl, 4-pyridyl) thiazolyl group, oxazolyl group, imidazolyl group, furyl group, thienyl group, pyrrolyl group, pyrazinyl group, pyrimidinyl group, pyridazinyl, selenazolyl group, sulforanyl group, piperidinyl group, pyrazolyl group and tetrazolyl group. The alkenyl group, alkynyl group, aryl group, and heterocyclic group may be substituted by the same substituent as the alkyl group represented by $R^{10}$, $R^{11}$, $R^{12}$, $R^{13}$, $R^{14}$, $R^{15}$, $R^{16}$ or $R^{17}$ or its substituent.

Examples of the substituent represented by $R^{14}$ include an alkyl group, alkenyl group, alkynyl group, aryl group, heterocyclic group, halogen atom alkoxy group, aryloxy group, alkoxycarbonyl group, aryloxycarbonyl group, sulfonamido group, sulfamoyl group, ureido group, acyl group, carbamoyl group, amido group, sulfonyl group, amino group, cyano group, nitro group, carboxy group, hydroxy group, hydrogen atom, mercapto group, alkylthio group, arylthio group, alkenylthio group, and heterocyclic-thio group. These groups maybe substituted by the same substituent as the alkyl group represented by $R^{10}$, $R^{11}$, $R^{12}$, $R^{13}$, $R^{14}$, $R^{15}$, $R^{16}$ or $R^{17}$ or its substituent.

Exemplary examples of the compounds represented by formulas (3), (3A) and (3B), but the compounds are not limited to these examples.

3-1

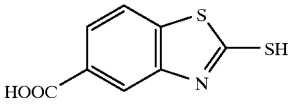

3-2

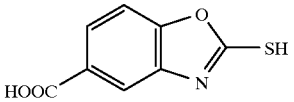

3-3

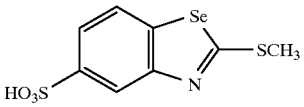

3-4

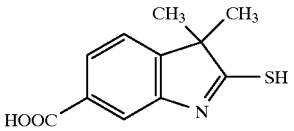

3-5

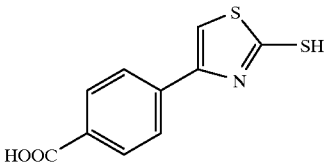

3-6

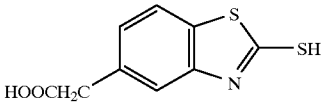

-continued 3-7

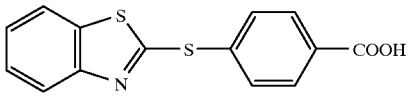

3A-1

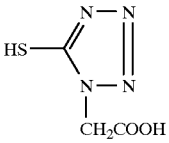

3A-2

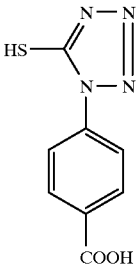

3A-3

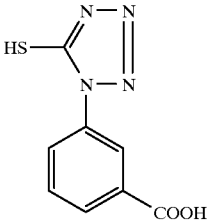

3A-4

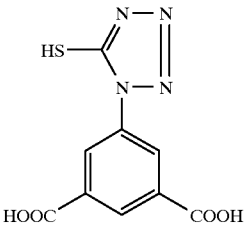

3A-5

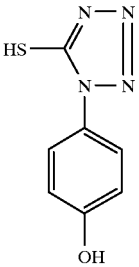

3A-6

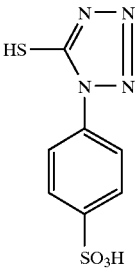

-continued 3A-7

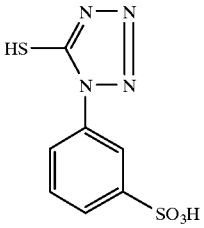

3A-8

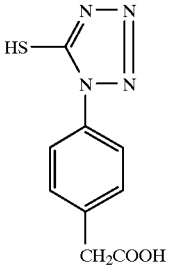

3B-1

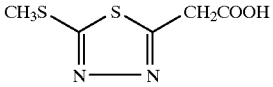

3B-2

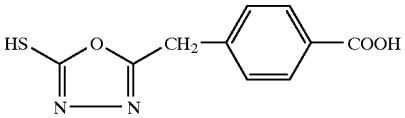

3B-3

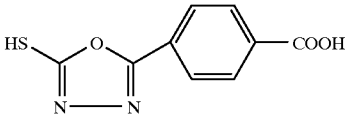

3B-4

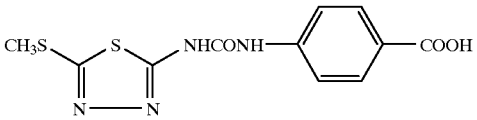

3B-5

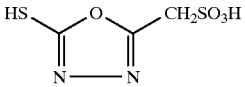

3B-6

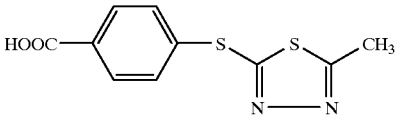

3B-7

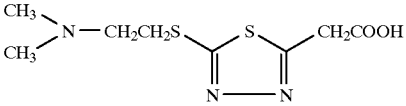

To achieve advantageous effects of the invention, the compound represented by formulas (3), (3A) and (3B) is incorporated in an amount of not less than $5.0\times10^{-4}$ mol and more preferably not less than $8.0\times10^{-4}$ mol per mol of silver halide. Incorporation of $1.0\times10^{-2}$ mol or more results in reduction of the sensitivity. The compound is preferably incorporated in all of layers containing the coupler of formula (1), but may be incorporated in one of them. The compound can be incorporated singly or in combination. In this case, the total amount to be incorporated is within the range described above.

According to the invention, the component layer containing the coupler represented by formula (1) preferably contains further a compound represented by formula (4) in an amount of not less than $4.0\times10^{-3}$ mol per mol of silver halide layer:

$$A_1—\{(L_1)a—(B_1)m\}p—(L_2)n—DI \qquad \text{Formula (4)}$$

wherein $A_1$ represents a group capable of releasing, through bond cleavage, $\{(L_1)a—(B_1)m\}p—(L_2)n—DI$ upon reaction with an oxidation product of an aromatic amine developing agent; $L_1$ represents a linkage group which is capable of cleaving the bond between $L_1$ and $B_1$ after the cleavage of the bond between $A_1$ and $L_1$; $B_1$ represents a group capable of releasing $(L_2)n—DI$, through bond cleavage between $B_1$ and $L_2$ represented by formula (4), upon reaction with the oxidation product of the developing agent; $L_2$ represents a linkage group which is capable of releasing DI, through bond cleavage between $L_2$ and DI; DI represents a development inhibitor; a, m, n each are an integer of 0 or 1; and p is an integer of 0,1 or 2, provided that when p is 2, each of $(L_1)a—(B_1)m$ may be the same or different.

Concretely, $A_1$ is a coupler residue or redox group. Examples of the coupler residue represented by $A_1$ include a yellow coupler residue (e.g., open-chained ketomethylene type coupler residue, such as acylacetoanilide or malonic dianilide), a magenta coupler residue (e.g., coupler residue, such as 5-pyrazolone type, pyrazolotriazole type or imidazopyrazole type), a cyan coupler residue (e.g., coupler residue, such as phenol type, naphthol type, imidazole type described in European Patents 249,453, pyrazolopyrimidine type described in 304,001) and a non-dye forming coupler residue (e.g., coupler residue, such as indanone type or acetophenone type). There is also included a heterocyclic ring type coupler residue, as described in U.S. Pat. Nos. 4,315,070, 4,183,752, 4,174,969, 3,961,959 and 4,171,223, and JP-A 52-82423.

The redox group refers to a group capable of being cross-oxidized by an oxidation product of a developing agent. Examples thereof include hydroquinones, catechols, pyrogallols, 1,4-naphthohydroquinones, 1,2-naphthohydroquinones, sulfonamidophenols, hydrazides and sulfonamidonaphthols. These groups are exemplarily described in JP-A 61-230135, 62-251746, 61-278852; U.S. Pat. Nos. 3,364,022, 3,379,529, 3,639,417, 4,684,604; and J. Org. Chem., 29, 588 (1964).

Examples of the linkage groups represented by $L_1$ and $L_2$ include a group employing cleavage reaction of a hemiacetal, as described in U.S. Pat. Nos. 4.146,396, 4,652,516 and 4,698,297; a timing group capable of causing cleavage reaction by employing intramolecular nucleophilic reaction, as described in U.S. Pat. Nos. 4,248,962, 4,857,440, and 4,847,185; a timing group capable of causing cleavage reaction by employing electron transfer reaction, as described in U.S. Pat. Nos. 4,409,323 and 4,421,845; a timing group capable of causing cleavage reaction by employing hydrolysis of a iminoketal, as described in U.S. Pat. Nos. 4,546,073 and a timing group capable of causing cleavage reaction by employing hydrolysis of an ester, as described in German Patent 2,626,317. $L_1$ and $L_2$ each are linked to $A_1$ or $A_1—(L_1)a—(B_1)m$, through a hetero atom, preferably a oxygen atom, sulfur atom or nitrogen atom.

The group represented by $B_1$ is one which becomes a redox group or a coupler after cleavage of $A_1—(L_1)$ bon, having the same meaning as described in $A_1$. The $B_1$ group contains a group capable of being released upon reaction with an oxidation product of a developing agent (i.e., a group bound to the right hand of $B_1$ in formula (4)). Examples of the $B_1$ group include one represented by $B_1$, as described in U.S. Pat. No. 4,824,772; one represented by COUP (B), as described in U.S. Pat. No. 4,438,193; and one represented by RED, as described in U.S. Pat. No. 4,618,571. The $B_1$ group is linked to $A_1—(L_1)a—$, through a hetero atom, preferably a oxygen atom or nitrogen atom.

In formula (4), the group represented by DI includes a tetrazolylthio group, a thiadiazolylthio group, an oxadiazolylthio group, a triazolylthio group, a benzimidazolylthio group, a benzthiazolylthio group, a tetrazolylseleno group, a benzoxazolylthio group, a benztriazolyl group, triazolyl group or a benzimidazolyl group. These f groups are described in U.S. Pat. Nos. 3,227,554, 3,384,657, 3,615,506, 3,617,291, 3,733,201, 3,933,500, 3,958,993, 3,961,959, 4,149,886, 4,259,437, 4,095,984, 4,477,563, and 4,782,012; European Patent 348,139A1 and 354,532A1; and British Patent 1,450,479.

Exemplary examples of the group represented by DI are shown below, in which the mark (*) represents the bonding position of the DI group.

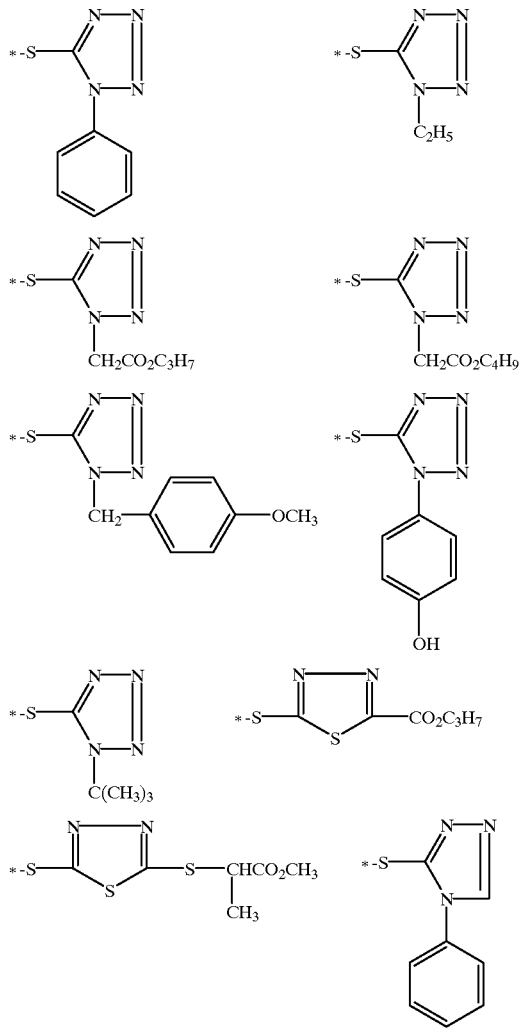

-continued

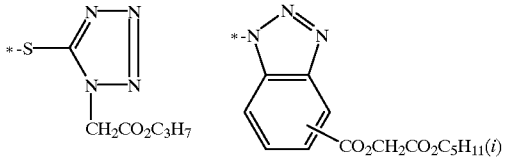

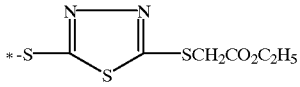

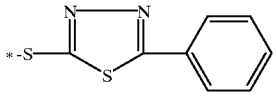

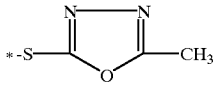

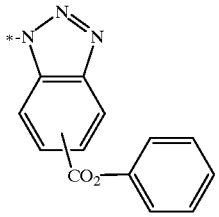

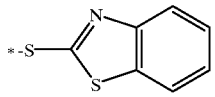

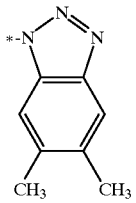

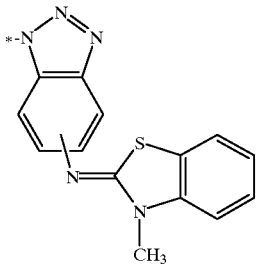

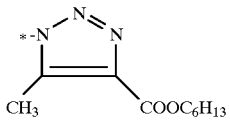

In formula (4), p is preferably 0 or 1. The compound represented by formula (4) is preferably non-diffusion type. Particularly, a ballast group is preferably contained in $A_1$, $L_1$ or $B_1$. More preferably, $A_1$ is a coupler residue.

A compound represented by formula (4) is preferable in the case of (i) a=1, m=0, p=1 and n=0; (ii) a=0, m=1, p=1 and n=0; or (iii) a=1, m=0, p=1 and n=1. These compounds are superior in color reproduction due to interimage effect and sharpness due to edge effect.

Compounds represented by formula (4) and synthetic methods thereof are described in patents cited for explanation of $A_1$, $L_1$, $B_1$, $L_2$ and DI, and JP-A 63-37346 and 61-156127.

Exemplary examples of the compound represented by formula (4) are shown below, but the compound is not limited these examples.

4-1

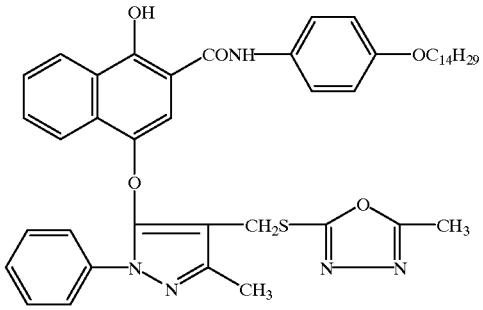

4-2

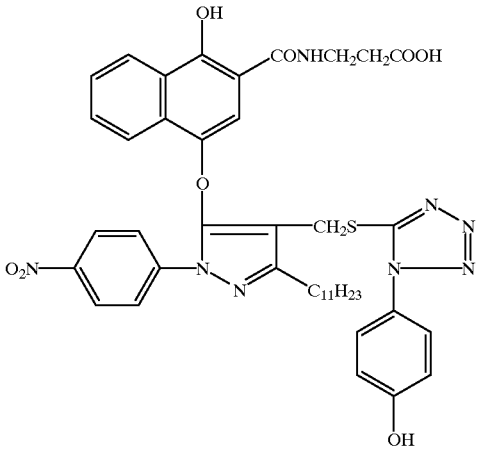

4-3

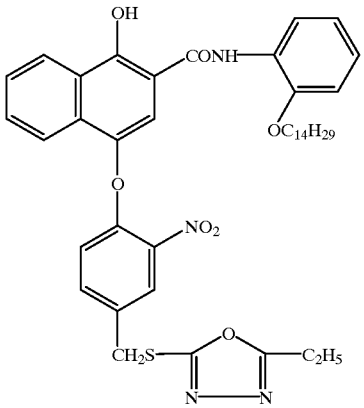

-continued 4-4

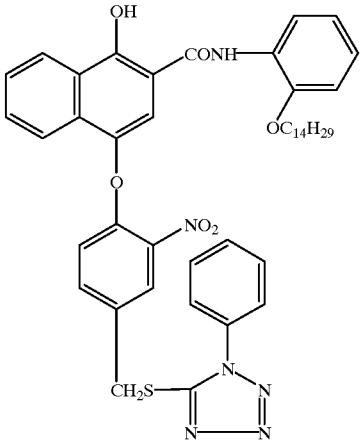

4-5

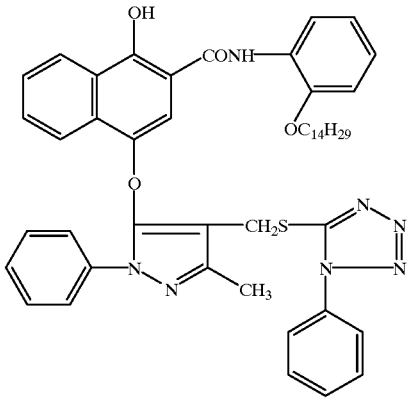

4-6

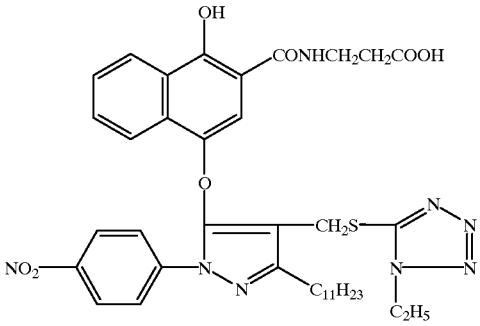

4-7

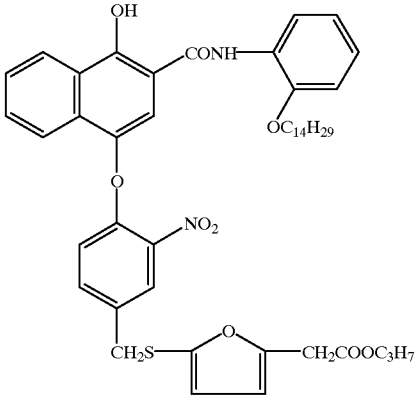

-continued 4-8

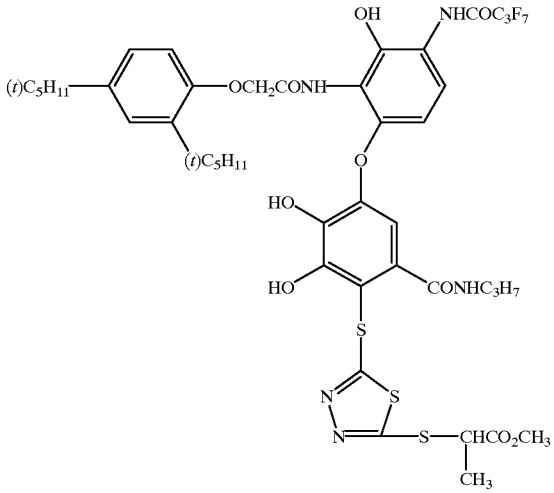

4-9

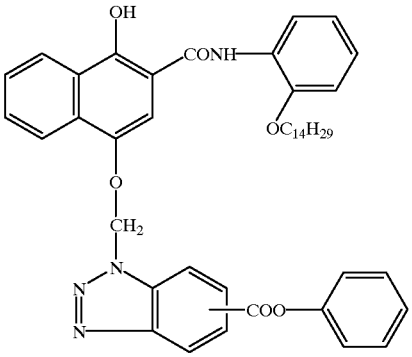

The compound represented by formula (4) is incorporated in an amount of $0.4\times10^{-2}$ mol or more, and preferably $0.6\times10_{-2}$ mol or more per mol of silver halide. Incorporated amounts of 0.10 mol or more results in reduction of sensitivity. The compound is preferably in all layers containing the coupler represented by formula (1), and even when incorporated in one layer, advantageous effects of the invention can be achieved. The compound can be incorporated singly or in combination thereof.

The coupler represented by formula (1) and the compound represented by formula (4) may be incorporated in a light sensitive silver halide emulsion layer or light insensitive layer. These compounds are incorporated through dispersing by various dispersing methods known in the art. For example, the compound represented by formula (1) or (4) is dissolved in a low-boiling solvent such as ethyl acetate or butyl acetate, or its mixture with a high-boiling solvent such as dibutyl phthalate or tricresyl phthalate, then, the resulting solution is further mixed with an aqueous solution containing a surfactant and emulsion-dispersed using a high-speed rotary mixer, colloid mill or ultrasonic homogenizer. The resulting dispersion is incorporated into a silver halide emulsion. The dispersion may be incorporated into the emulsion after setting and subjecting to water washing. The compounds represented by formula (1) and (4) may be incorporated to the same layer or different layers, or different layers which have the same spectral sensitivity. In the case when incorporated into the same layer, the compounds may be incorporated by dispersing separately or mixedly at the same time.

In the invention, there can be employed chemically sensitized silver halide emulsion. As a chemical sensitizer is preferably employed sulfur sensitizer, selenium sensitizer or tellurium sensitizer. The silver halide emulsion can be spectrally sensitized, and an antifoggant or stabilizer can be employed. Examples of sensitizing dyes include cyanine dyes, merocyanine dyes, complex cyanine dyes, complex merocyanine dyes, holo-polar cyanine dyes, hemi-cyanine dyes, styryl dyes, hemioxonol dyes, and polymethine dyes such as oxonol, mero-styryl and streptocyanine dyes.

In hydrophilic colloidal layers of the photographic material according to the invention is generally employed gelatin. The gelatin includes lime-processed gelatin, acid-processed gelatin, enzyme-treated gelatin described in Bull. Soc. Sci. Phot. Japan No.16, page 30 (1966), and gelatin derivatives, those which can be obtained by causing gelatin to react with various compounds such as acid halides, acid anhydrides, isocyanates, bromoacetic acid, alkane sultones, vinyl sulfonamides, maleimides, polyalkylene oxides, and epoxy compounds.

As a support used in the photographic material according to the invention are preferably used cellulose ester films, polyester films, and polycarbonate films. In particular, cellulose triacetate film, polyethylene terephthalate film, polyethylene naphthalate film and poly-p-phenylene terephthalate film are preferably used.

The present invention can be applied to a variety of color photographic materials including color negative films for general use or use for cine, color reversal films for slide or TV and color positive films.

EXAMPLES

The present invention will be explained based examples, but embodiments of the invention are not limited these examples.

In all of the examples, the addition amount to the silver halide photographic light sensitive material is expressed in terms of an equivalent amount of silver ($g/m^2$) with respect to silver halide or colloidal silver, $g/m^2$ with respect to coupler or additives, and mole number per mol of silver halide contained in the same layer with respect to a sensitizing dye.

Example 1

On a triacetyl cellulose film support were formed the following layers containing composition as shown below to prepare a multi-layered color photographic material Sample 101 prepare Sample 101.

| | |
|---|---|
| 1st Layer: Anti-Halation Layer | |
| Black colloidal silver | 0.16 |
| UV absorbent (UV - 1) | 0.20 |
| High boiling solvent (Oil - 1) | 0.16 |
| Gelatin | 1.23 |
| 2nd Layer: Intermediate Layer | |
| High boiling solvent (Oil - 1) | 0.17 |
| Gelatin | 1.27 |
| 3rd Layer: Low-speed Red-Sensitive Layer | |
| Silver iodobromide emulsion Em-204 | 0.50 |
| Silver iodobromide emulsion Em-205 | 0.21 |
| Sensitizing dye (SD - 1) | $2.8 \times 10^{-4}$ |
| Sensitizing dye (SD - 2) | $1.9 \times 10^{-4}$ |
| Sensitizing dye (SD - 3) | $1.9 \times 10^{-5}$ |
| Sensitizing dye (SD - 4) | $1.0 \times 10^{-4}$ |
| Cyan coupler (C - 1) | 0.50 |
| Colored cyan coupler (CC - 1) | 0.021 |
| Exemplified compound (4-1) | 0.020 |

-continued

| | |
|---|---|
| High boiling solvent (Oil-4) | 0.53 |
| Gelatin | 1.30 |
| 4th Layer: Medium-speed Red-sensitive Layer | |
| Silver iodobromide emulsion Em-203 | 0.62 |
| Silver iodobromide emulsion Em-204 | 0.27 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan coupler (C-1) | 0.20 |
| Cyan coupler (C-2) | 0.10 |
| Colored cyan coupler (CC-1) | 0.030 |
| Exemplified compound (4-1) | 0.013 |
| High boiling solvent (Oil-1) | 0.30 |
| Gelatin | 0.93 |
| 5th Layer: High-speed Red-Sensitive Layer | |
| Silver iodobromide emulsion Em-201 | 1.27 |
| Sensitizing dye (SD - 1) | $1.3 \times 10^{-4}$ |
| Sensitizing dye (SD - 2) | $1.3 \times 10^{-4}$ |
| Sensitizing dye (SD - 3) | $1.6 \times 10^{-5}$ |
| Cyan coupler (C - 2) | 0.12 |
| Coiored cyan coupler (CC - 1) | 0.013 |
| High boiling solvent (Oil-1) | 0.14 |
| Gelatin | 0.91 |
| 6th Layer: Intermediate Layer | |
| High boiling solvent (Oil-2) | 0.11 |
| Gelatin | 0.80 |
| 7th Layer: Low-speed Green-Sensitive Layer | |
| Silver iodobromide emulsion Em-204 | 0.61 |
| Silver iodobromide emulsion Em-205 | 0.20 |
| Sensitizing dye (SD-5) | $6.0 \times 10^{-5}$ |
| Sensitizing dye (SD-6) | $3.0 \times 10^{-4}$ |
| Sensitizing dye (SD-7) | $3.0 \times 10^{-4}$ |
| Magenta coupler (M - 1) | 0.64 |
| Colored magenta coupler (CM - 2) | 0.12 |
| Exemplified compound (4-2) | 0.009 |
| High boiling solvent (Oil-2) | 0.75 |
| Gelatin | 1.95 |
| 8th Layer: Medium-speed Green-Sensitive Layer | |
| Silver iodobromide emulsion Em-203 | 0.87 |
| Sensitizing dye (SD-5) | $4.8 \times 10^{-4}$ |
| Sensitizing dye (SD-6) | $2.4 \times 10^{-4}$ |
| Sensitizing dye (SD-7) | $2.4 \times 10^{-4}$ |
| Magenta coupler (M - 1) | 0.20 |
| Colored cyan couple (CM - 2) | 0.070 |
| Exemplified compound (4-2) | 0.010 |
| High boiling solvent (Oil-2) | 0.50 |
| Gelatin | 1.00 |
| 9th Layer: High-speed Green-Sensitive Layer | |
| Silver iodobromide emulsion Em-201 | 1.27 |
| Sensitizing dye (SD-5) | $2.2 \times 10^{-4}$ |
| Sensitizing dye (SD-6) | $1.1 \times 10^{-4}$ |
| Sensitizing dye (SD-7) | $1.1 \times 10^{-4}$ |
| Magenta coupler (M - 1) | 0.15 |
| Colored cyan couple (CM - 2) | 0.012 |
| High boiling solvent (Oil-1) | 0.27 |
| High boiling solvent (Oil-2) | 0.012 |
| Gelatin | 1.00 |
| 10th Layer: Yellow Filter Layer | |
| Yellow colloidal silver | 0.08 |
| Antistaining agent (SC-1) | 0.15 |
| Formalin scavenger (HS-1) | 0.20 |
| High boiling solvent (Oil-2) | 0.19 |
| Gelatin | 1.10 |
| 11th Layer: Interlayer | |
| Formalin scavenger (HS-1) | 0.20 |
| Gelatin | 0.60 |
| 12th Layer: Low-speed Blue-sensitive Layer | |
| Silver iodobromide emulsion Em-202 | 0.07 |
| Silver iodobromide emulsion Em-204 | 0.16 |
| Silver iodobromide emulsion Em-205 | 0.10 |

-continued

| | |
|---|---|
| Sensitizing dye (SD-8) | $7.9 \times 10^{-4}$ |
| Yellow coupler (Y-1) | 0.80 |
| High boiling solvent (Oil-2) | 0.30 |
| Gelatin | 1.20 |
| 13th Layer: High-sped Blue-sensitive Layer | |
| Silver iodobromide emulsion Em-206 | 0.90 |
| Sensitizing dye (SD-8) | $3.2 \times 10^{-4}$ |
| Yellow coupler (Y-1) | 0.15 |
| High boiling solvent (Oil-2) | 0.046 |
| Gelatin | 0.80 |
| 14th Layer: First Protective Layer | |
| Silver iodobromide emulsion (av. grain size 0.08 μm, 1.0 mol % iodide) | 0.40 |
| UV absorbent (UV-1) | 0.065 |
| UV absorbent (UV-2) | 0.10 |
| High boiling solvent (Oil-1) | 0.07 |
| High boiling solvent (Oil-3) | 0.07 |

-continued

| | |
|---|---|
| Formalin scavenger (HS-1) | 0.40 |
| Gelatin | 1.31 |
| 15th Layer: Second protective Layer | |
| Alkali-soluble matting agent (PM-1 av. particle size 2 μm) | 0.15 |
| Polymethylmethacrylate (av. size 3 μm) | 0.04 |
| Slipping agent (WAX-1) | 0.04 |
| Gelatin | 0.55 |

In addition to the above composition, there were added coating-aids SU-1 and SU-2, V-1, hardening agent H-1 and H-2, stabilizers ST-1, antifoggant AF-1, Dye AI-1 and AI-2, and anti-septic DI-1. The addition amount of DI-1 was 9.4 $mg/m^2$.

C-1

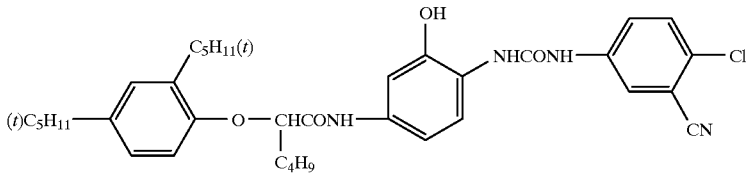

C-2

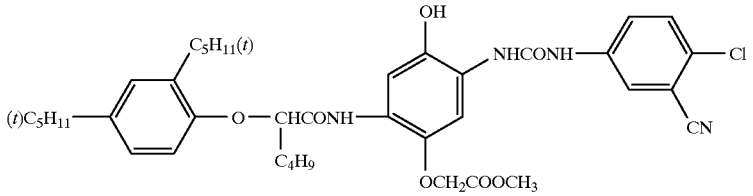

M-1

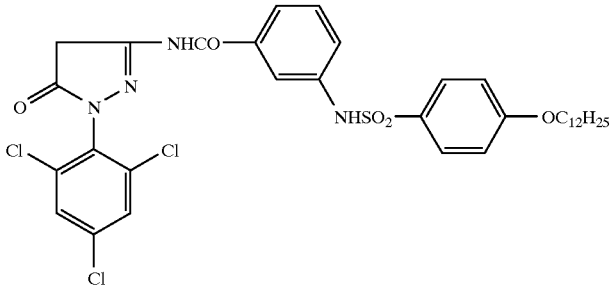

Y-1

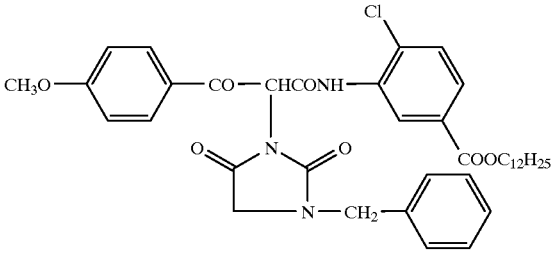

-continued
CC-1
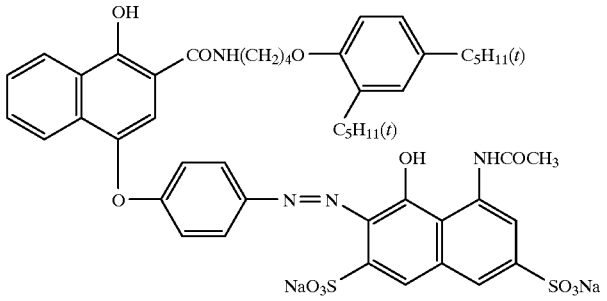
CM-2
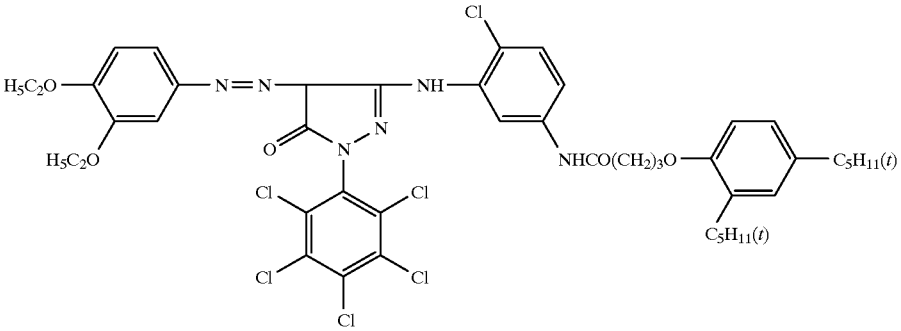
Oil-1
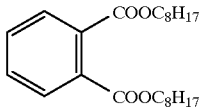
Oil-2
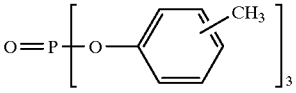
Oil-3
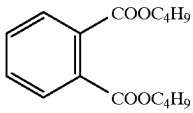
SC-1
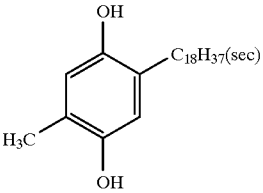
PM-1
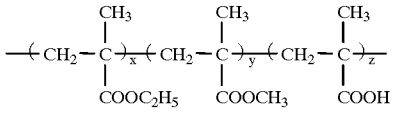
*x*:*y*:*z* = 3:3:4
UV-1
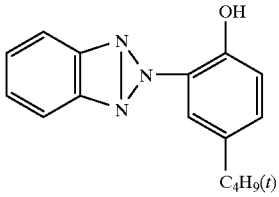

-continued
UV-2
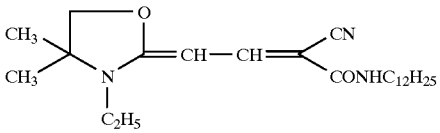
WAX-1
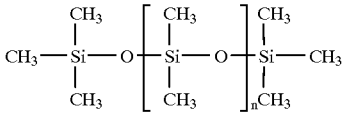
Weight-averaged molecular weight: 3,000
Su-1
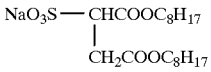
Su-2
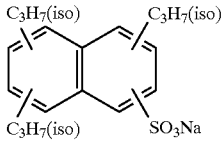
HS-1
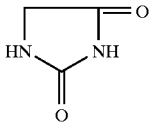
SD-1
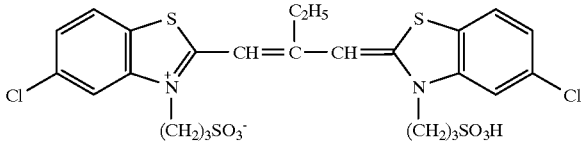
SD-2
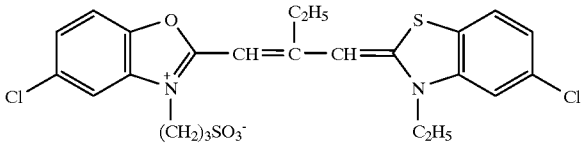
SD-3
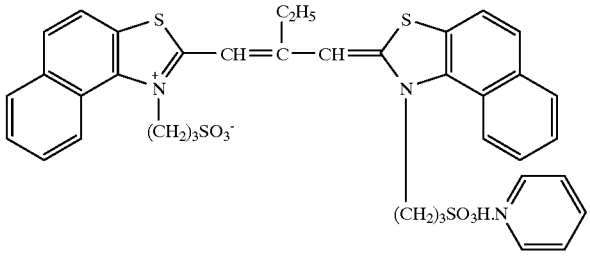
SD-4
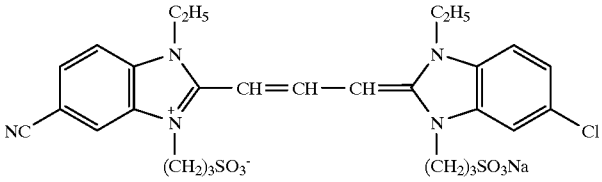

-continued
SD-5
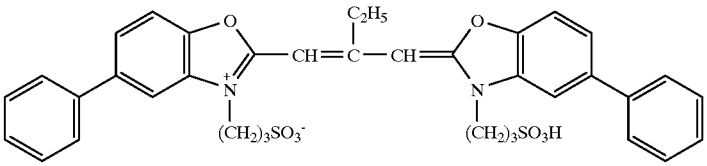
SD-6
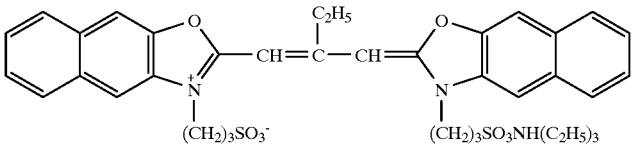
SD-7
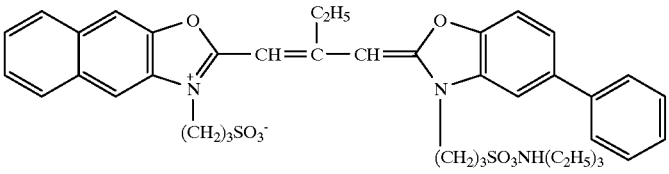
SD-8
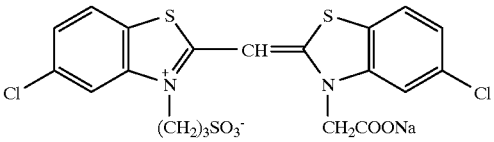
H-1
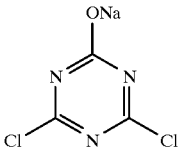
H-2
$(CH_2{=}CHSO_2CH_2)_2O$
ST-1
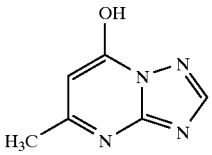
AF-1
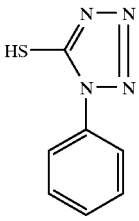
DI-1
(Mixture of the following components)
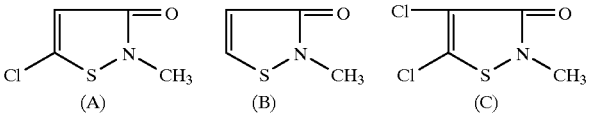
(A) (B) (C)
A:B:C = 50:46:4 (molar ratio)

-continued

AI-1

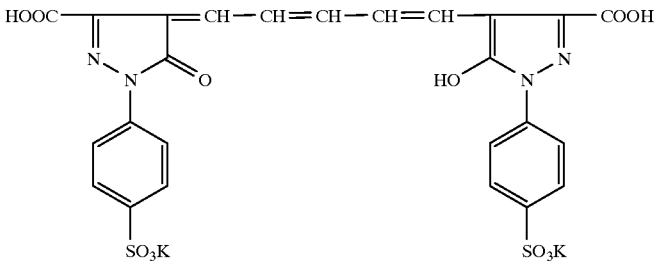

AI-2

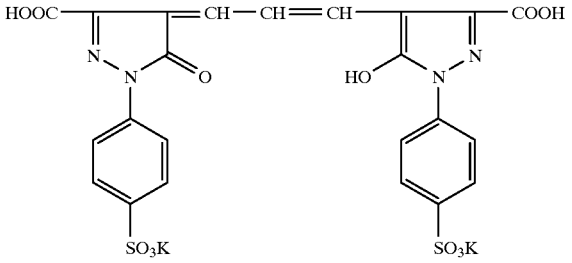

V-1

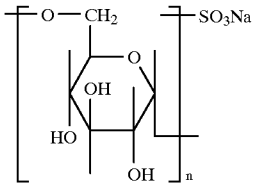

Silver iodobromide emulsions employed in Sample 101 is summarized in Table 1, with respect to average grain size, average aspect ratio and average iodide content. These emulsions each were employed after subjected to chemical and spectral sensitization using sensitizing dyes SD-1 to SD-8, sodium thiosulfate, chloroauric acid, and ammonium thiocyanate.

TABLE 1

| Emulsion | Av. grain size (μm) | Av. aspect ratio | Av. iodide content (mol %) |
|---|---|---|---|
| Em-201 | 0.70 | 2.8 | 8 |
| Em-202 | 0.59 | 2.5 | 10 |
| Em-203 | 0.59 | 2.5 | 8 |
| Em-204 | 0.38 | 1.5 | 8 |
| Em-205 | 0.27 | 1.5 | 6 |
| Em-206 | 0.95 | 2.8 | 10 |

Samples 102 to 108:

Samples 102 to 108 were prepared in the same manner as Sample 101, except that the magenta coupler used in the 7–9th layers (M-1) was replaced by a coupler as shown in Table 3, a compound represented by formula (5) was added, emulsions Em-201 to 206 were replaced emulsions Em-301 to 306, respectively, and the EAg of the coating layer was adjusted so as to exhibit values as shown in Table 3, using potassium bromide or silver nitrate. Emulsion grains of each of Em-301 to 306 were proved to have dislocation lines within the grain.

TABLE 2

| Emulsion | Av. grain size (μm) | Av. aspect ratio | Av. iodide content | Dislocation line |
|---|---|---|---|---|
| Em-301 | 0.70 | 9.0 | 4.0 (mol %) | Yes |
| Em-302 | 0.59 | 8.0 | 5.5 | Yes |
| Em-303 | 0.59 | 8.0 | 4.0 | Yes |
| Em-304 | 0.38 | 6.0 | 4.0 | Yes |
| Em-305 | 0.27 | 6.0 | 4.0 | Yes |
| Em-306 | 0.95 | 9.0 | 5.5 | Yes |

Thus prepared samples each were subjected to wedge exposure in a conventional manner and processed according to the following processing steps.

| Processing steps | | |
|---|---|---|
| Color developing | 38.0 ± 0.1° C. | 3 min 15 sec |
| Bleaching | 38.0 ± 3.0° C. | 6 min 30 sec |
| Washing | 24–41° C. | 3 min 15 sec |
| Fixing | 38.0 + 3.0° C. | 6 min 30 sec |
| Washing | 24–41° C. | 3 min 15 sec |
| Stabilizing | 38.0 + 3.0° C. | 3 min 15 sec |
| Drying | 50° C. or lower | |

| Color developing solution | |
|---|---|
| 4-Amino-3-methyl-N-ethyl-N-(β-hydroxy ethyl)aniline sulfate | 4.75 g |
| Sodium sulfite anhydride | 4.25 g |
| Hydroxylamine ½ sulfate | 2.00 g |
| Potassium carbonate anhydride | 37.5 g |
| Sodium bromide | 1.30 g |
| Trisodium nitrilotriacetate (monohydrate) | 2.50 g |
| Potassium hydroxide | 1.00 g |
| Water to make | 1 liter |
| The pH was adjusted to 10.1. | |

| Bleaching solution | |
|---|---|
| Ammonium ferric ethylenediaminetetraacetate | 100.0 g |
| Diammonium ethylenediaminetetraacetate | 10.0 g |
| Ammonium bromide | 150 0 g |
| Glacial acetic acid | 10.0 g |
| Water to make | 1 liter |
| The pH was adjusted to 6.0. | |

| Fixing solution | |
|---|---|
| Ammonium thiosulfate | 175.0 g |
| Sodium sulfite anhydride | 8.5 g |
| Sodium metasulfite | 2.3 g |
| Water to make | 1 liter |
| The pH was adjusted to 6.0 with acetic acid. | |

| Stabilizing solution | |
|---|---|
| Formalin (37% aqueous solution) | 1.5 cc |
| Koniducks (product by Konica Corp.) | 7.5 cc |
| Water to make | 1 liter |

Sensitivity was shown as a relative value of reciprocal of exposure giving a magenta density of Dmin+0.20, based on that of Sample 101 being 100, in which the term, Dmin referred to a minimum density. Graininess was shown as a relative value of a RMS value at a density of Dmin+0.20 which was measured by a microdensitometer, based on that of Sample 101 being 100.

Formaldehyde resistance (denoted as HCHO rest.) was shown as a percentage of residual density of Dmax (magenta) after allowed to stand under environment filled with formaldehyde at 23° C. and 60% RH, over a period of one week, in which the term, Dmax referred to a maximum density.

Fog was shown as a difference between Dmin and a minimum density obtained at the time when developed with a developer not containing 4-Amino-3-methyl-N-ethyl-N-(β-hydroxyethyl)aniline sulfate.

Results are summarized in Table 3.

TABLE 3

| Sample | Coupler | Compd. (5) | Emulsion | EAg | Sensitivity | Graininess | HCHO rest. | Fog |
|---|---|---|---|---|---|---|---|---|
| 101(Comp) | M-1 | — | T-1* | 140 | 100 | 100 | 60 | 0.17 |
| 102(Comp) | 1-3 | — | T-1 | 140 | 143 | 140 | 94 | 0.31 |
| 103(Inv) | 1-3 | — | T-1 | 115 | 130 | 96 | 97 | 0.21 |
| 104(Inv) | 1-3 | — | T-1 | 90 | 128 | 81 | 96 | 0.14 |
| 105(Comp) | 1-3 | — | T-2* | 140 | 144 | 145 | 95 | 0.36 |
| 106(Inv) | 1-3 | — | T-2 | 90 | 142 | 82 | 97 | 0.15 |
| 107(Inv) | 1-3 | 5-5 | T-2 | 90 | 141 | 79 | 96 | 0.12 |
| 108(Inv) | 1-28 | 5-5 | T-2 | 90 | 138 | 80 | 95 | 0.12 |

*T-1: Emulsions Em-201 to 206 were employed
T-2: Emulsions Em-301 to 306 were employed

Example 2

Photographic material Sample 201 was prepared in the same manner as Sample 101, except that magenta couplers (M-1) and (CM-2) employed in the 7 to 9th layers were replaced by equimolar amount of the following (M-2) and (CM-1), respectively.

M-2

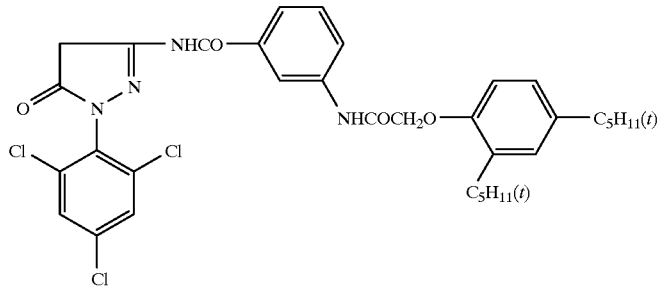

CM-1

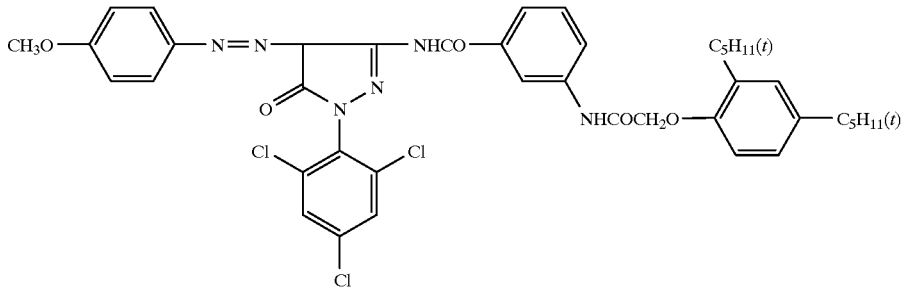

Samples 202 to 208 were prepared in the same manner as Sample 201, except that the magenta coupler used in the 7–9th layers (M-2) was replaced by a coupler as shown in Table 4, a compound represented by formula (5) was further added, emulsions Em-201 to 206 were replaced emulsions Em-301 to 306, respectively, and the EAg of the coating layer and the pH of the outermost surface were respectively adjusted so as to exhibit values as shown in Table 4, using potassium bromide and silver nitrate, or sulfuric acid and sodium hydroxide. Samples were evaluated in the same manner as in Example 1, provided that the sensitivity and graininess were respectively shown as a relative value, based on those of Sample 201 being 100.

TABLE 4

| Sample | Coupler | Compd. (5) | Emulsion | EAg | pH | Sensitivity | Graininess | HCHO rest. | Fog |
|---|---|---|---|---|---|---|---|---|---|
| 201(Comp) | M-2 | — | T-1* | 140 | 5.8 | 100 | 100 | 60 | 0.17 |
| 202(Comp) | 1-3 | — | T-1 | 140 | 5.8 | 143 | 140 | 94 | 0.31 |
| 203(Inv) | 1-3 | — | T-1 | 115 | 5.8 | 130 | 96 | 97 | 0.21 |
| 204(Inv) | 1-3 | — | T-1 | 90 | 5.3 | 130 | 80 | 97 | 0.13 |
| 205(Comp) | 1-3 | — | T-1 | 140 | 5.3 | 142 | 144 | 95 | 0.35 |
| 206(Inv) | 1-3 | — | T-1 | 115 | 5.3 | 132 | 92 | 96 | 0.19 |
| 207(Inv) | 1-3 | — | T-1 | 115 | 4.9 | 132 | 84 | 96 | 0.16 |
| 208(Inv) | 1-3 | — | T-2* | 115 | 5.3 | 136 | 80 | 97 | 0.14 |
| 209(Inv) | 1-3 | 5-5 | T-2 | 115 | 4.9 | 137 | 79 | 97 | 0.12 |
| 210(Inv) | 1-28 | 5-5 | T-2 | 90 | 5.3 | 136 | 76 | 97 | 0.12 |

*T-1: Emulsions Em-201 to 206 were employed
T-2: Emulsions Em-301 to 306 were employed

Example 3

Photographic material Sample 301 was prepared in the same manner as sample 101, except that colored magenta (CM-2) employed in the 7–9th layers were replaced by an equimolar amount of CM-1.

Sample 302 was prepared in the same manner as Sample 301, except that magenta coupler (M-1) was replaced by magenta coupler (1-3). Sample 303 was prepared in the same manner as Sample 302, except that a polymeric compound represented by formula (2), P-1 having number-averaged molecular weight of 2,500 was further added to the 7–9th layers in an amount of 1.5 g per mol of silver halide. Sample 304 was prepared in the same manner as Sample 302, except that polymeric compound, P-1 having a number-averaged molecular weight of 2,500 was added in an amount of 5.0 g per mol of silver halide. Sample 305 was prepared in the same manner as Sample 302, except that polymeric compound, P-1 having a number-averaged molecular weight of 8,000 was added in an amount of 5.0 g per mol of silver halide. Sample 306 was prepared in the same manner as Sample 304, except that emulsions Em-201 to 206 were replaced by emulsions Em-301 to 306, respectively. Sample 307 was prepared in the same manner as Sample 306, except that a compound (5-5) was further added to the 7–9th layers in an amount of 30% by weight based on the coupler ((1-3). Sample 308 was prepared in the same manner as Sample 307, except that the polymeric compound (P-1) was replaced by a polymeric compound, p-2 having a number-averaged molecular weight of 2,500. Sample 309 was prepared in the same manner as Sample 307, except that the magenta coupler (1-3) was replaced by magenta coupler, (1-28). Sample 310 was prepared in the same manner as Sample 309, except that the polymeric compound was replaced by a polymeric compound, P-1 having a number-averaged molecular weight of 250. Sample 311 was prepared in the same manner as Sample 309, except that the polymeric compound was replaced by a polymeric compound, P-1 having a number-averaged molecular weight of 30,000. In Samples 302 to 311, an addition amount of the magenta coupler was adjusted so as to produce an equal density, and the EAg of the coating layer was adjusted to exhibit 115 mV, using aqueous solutions of potassium bromide and silver nitrate.

These samples were evaluated in the same manner as in Example 1. Results thereof are summarized in Table 5. The sensitivity and graininess each were shown as a relative value, based on those of Sample 301 being 100.

TABLE 5

| Sample | Coupler | Compd. (5) | Emulsion | EAg | Polymer Kind | Polymer M.W. | Polymer Amt. | Sensitivity | Graininess | HCHO rest. | Fog |
|---|---|---|---|---|---|---|---|---|---|---|---|
| 301 (Comp) | M-1 | — | T-1* | 140 | — | — | — | 100 | 100 | 58 | 0.17 |
| 302 (Inv) | 1-3 | — | T-1 | 115 | — | — | — | 132 | 98 | 95 | 0.22 |
| 303 (Inv) | 1-3 | — | T-1 | 115 | P-1 | 2500 | 1.5 | 134 | 97 | 96 | 0.20 |
| 304 (Inv) | 1-3 | — | T-1 | 115 | P-1 | 2500 | 5.0 | 131 | 81 | 97 | 0.13 |
| 305 (Inv) | 1-3 | — | T-1 | 115 | P-1 | 8000 | 5.0 | 136 | 94 | 96 | 0.20 |
| 306 (Inv) | 1-3 | — | T-2* | 115 | P-1 | 2500 | 5.0 | 144 | 80 | 96 | 0.16 |
| 307 (Inv) | 1-3 | 5-5 | T-2 | 115 | P-1 | 2500 | 5.0 | 144 | 79 | 97 | 0.13 |
| 308 (Inv) | 1-3 | 5-5 | T-2 | 115 | P-2 | 2500 | 5.0 | 140 | 76 | 97 | 0.12 |
| 309 (Inv) | 1-28 | 5-5 | T-2 | 115 | P-1 | 2500 | 5.0 | 139 | 76 | 96 | 0.12 |
| 310 (Inv) | 1-28 | 5-5 | T-2 | 115 | P-1 | 250 | 5.0 | 122 | 76 | 97 | 0.11 |
| 311 (Inv) | 1-28 | 5-5 | T-2 | 115 | P-1 | 30000 | 5.0 | 124 | 87 | 96 | 0.16 |

*T-1: Emulsions Em-201 to 206 were employed
T-2: Emulsions Em-301 to 306 were employed

Example 4

Photographic material Sample 401 was prepared in the same manner as Sample 101, except that the magenta coupler (M-1) was replaced by a magenta coupler (M-2) and a compound represented by formula (3), 3A-3 was further added to the 7 to 9th layers in an amount of $1.0\times10^{-4}$ mol per mol of silver halide.

Samples 402 to 409 were prepared in the same manner as in Sample 401, except that the compound represented by formula (3) was varied, a compound represented by formula (5) was added to the 7 to 9th layers and emulsions Em-201 to 206 was varied to Em-301 to 306, respectively, as shown in Table 6. In each of Samples 402 to 409, the EAg of the coating layer was adjusted to exhibit 115 mV, using aqueous solutions of potassium bromide and silver nitrate. Thus prepared samples were evaluated in the same manner as in Example 1. Results thereof are summarized in Table 6. The sensitivity and graininess each were shown as a relative value, based on those of Sample 401 being 100.

TABLE 6

| Sample | Coupler | Compd. (5) | Emulsion | EAg | Compd. (3) (mol/mol AgX) | | Sensitivity | Graininess | HCHO rest. | Fog |
|---|---|---|---|---|---|---|---|---|---|---|
| 401 (Comp) | M-2 | — | T-1* | 140 | 3A-3 | $(1.0\times10^{-4})$ | 100 | 100 | 59 | 0.15 |
| 402 (Inv) | 1-3 | — | T-1 | 115 | 3A-3 | $(1.0\times10^{-4})$ | 135 | 98 | 93 | 0.25 |
| 403 (Inv) | 1-3 | — | T-1 | 115 | 3A-3 | $(5.0\times10^{-4})$ | 133 | 97 | 96 | 0.20 |
| 404 (Inv) | 1-3 | — | T-1 | 115 | 3A-3 | $(8.0\times10^{-4})$ | 128 | 78 | 98 | 0.14 |
| 405 (Comp) | 1-3 | — | T-2* | 115 | 3A-3 | $(1.0\times10^{-4})$ | 146 | 89 | 92 | 0.17 |
| 406 (Inv) | 1-3 | — | T-2 | 115 | 3A-3 | $(8.0\times10^{-4})$ | 144 | 76 | 97 | 0.14 |
| 407 (Inv) | 1-3 | 5-5 | T-2 | 115 | 3A-3 | $(8.0\times10^{-4})$ | 146 | 75 | 98 | 0.11 |
| 408 (Inv) | 1-28 | 5-5 | T-2 | 115 | 3A-3 | $(8.0\times10^{-4})$ | 144 | 76 | 97 | 0.10 |
| 408 (Inv) | 1-28 | 5-5 | T-2 | 115 | 3A-6 | $(8.0\times10^{-4})$ | 146 | 76 | 96 | 0.10 |

*T-1: Emulsions Em-201 to 206 were employed
T-2: Emulsions Em-301 to 306 were employed

Example 5

Photographic material Sample 501 was prepared in the same manner as Sample 301, except that a compound represented by formula (4), 4-2 was added to the 9th layer in an amount of 0.0145 g. The content of the compound (4-2) in each of the 7 to 9th layers was $1.5\times10^{-3}$ mol per mol of silver halide.

Samples 502 to 510 were prepared in the same manner as Sample 501, except that a compound represented by formula (4) added to the 9th layer was varied, a compound represented by formula (5) was added to the 7 to 9th layers and emulsions Em-201 to 206 was varied to Em-301 to 306, respectively, as shown in Table 7. In each of Samples 502 to 510, the EAg of the coating layer was adjusted to exhibit 115 mV, using aqueous solutions of potassium bromide and silver nitrate. Thus prepared samples were evaluated in the same manner as in Example 1. Results thereof are summarized in Table 7. The sensitivity and graininess each were shown as a relative value, based on those of Sample 501 being 100.

TABLE 7

| Sample | Coupler | Compd. (5) | Emulsion | EAg | Compd. (4) (mol/mol AgX) | Sensitivity | Graininess | HCHO rest | Fog |
|---|---|---|---|---|---|---|---|---|---|
| 501 (Comp) | M-1 | — | T-1* | 140 | 4-2 ($1.5 \times 10^{-3}$) | 100 | 100 | 58 | 0.14 |
| 502 (Inv) | 1-3 | — | T-1 | 115 | 4-2 ($1.5 \times 10^{-3}$) | 130 | 98 | 92 | 0.23 |
| 503 (Inv) | 1-3 | — | T-1 | 115 | 4-2 ($4.0 \times 10^{-3}$) | 131 | 94 | 96 | 0.20 |
| 504 (Inv) | 1-3 | — | T-1 | 115 | 4-2 ($6.0 \times 10^{-3}$) | 129 | 80 | 99 | 0.14 |
| 505 (Comp) | 1-3 | — | T-2* | 115 | 4-2 ($1.5 \times 10^{-3}$) | 133 | 88 | 93 | 0.19 |
| 506 (Inv) | 1-3 | — | T-2 | 115 | 4-2 ($6.0 \times 10^{-3}$) | 140 | 78 | 98 | 0.13 |
| 507 (Inv) | 1-3 | 5-5 | T-2 | 115 | 4-2 ($6.0 \times 10^{-3}$) | 139 | 72 | 98 | 0.11 |
| 508 (Inv) | 1-3 | 5-5 | T-2 | 115 | 4-4 ($6.0 \times 10^{-3}$) | 139 | 72 | 98 | 0.11 |
| 509 (Inv) | 1-3 | 5-5 | T-2 | 115 | 4-2/4-4 ($6.0 \times 10^{-3}$) = 1/1 | 139 | 74 | 97 | 0.11 |
| 510 (Inv) | 1-28 | 5-5 | T-2 | 115 | 4-4 ($6.0 \times 10^{-3}$) | 137 | 73 | 97 | 0.10 |

*T-1: Emulsions Em-201 to 206 were employed
T-2: Emulsions Em-301 to 306 were employed

What is claimed is:

1. A silver halide color photographic light sensitive material comprising a support having thereon photographic component layers including a silver halide emulsion layer, wherein at least one of the component layers contains a coupler represented by the following formula (1), the photographic material having an overall silver potential of 50 to 120 mV:

formula (1)

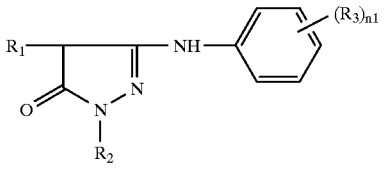

wherein $R_1$ represents a hydrogen atom or a coupling-off group capable of being released upon reaction with an oxidation product of a developing agent; $R_2$ represents an aryl group; $R_3$ represents a substituent; n is an integer of 1 to 5.

2. The photographic material of claim 1, wherein a pH of a surface of the emulsion layer-side of the photographic material is 4.1 to 5.5.

3. The photographic material of claim 1, wherein the component layer further contains a polymeric compound having a number-averaged molecular weight of not less than 500 and less than 20,000 and having a repeating unit represented by the following formula (2):

formula (2)

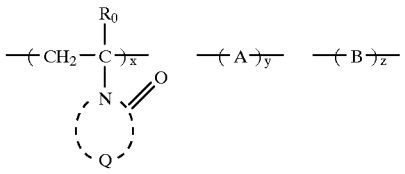

wherein $R_0$ represents a hydrogen atom or an alkyl group; Q represents a nonmetallic atom group necessary for forming a 5 to 7-membered ring including —N— and >C═O; A and B each represent a ethylenic unsaturated compound which is copolymerizable; x, y and z each are represented in terms of mol %, $10 \leqq x \leqq 100$, $0 \leqq y \leqq 90$ and $0 \leqq z \leqq 90$.

4. The photographic material of claim 1, wherein the component layer further contains a compound represented by formula (3):

Het-(SR)i formula (3)

wherein Het represents a heterocyclic ring; R represents a hydrogen atom, an alkyl group, alkenyl group, aryl group or heterocyclic group; and i is an integer of 0, 1 or 2.

5. The photographic material of claim 4, wherein said compound represented by formula (3) is represented by the following formula (3A) or (3B):

formula (3A)

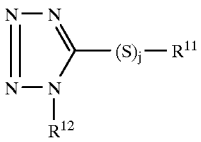

wherein $R^{11}$ and $R^{12}$ each represent a hydrogen atom, an alkyl group, alkenyl group, alkynyl group, aryl group or heterocyclic group; and J is an integer of 0 or 1;

formula (3B)

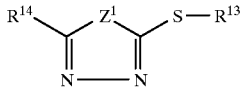

wherein $R^{13}$ represents a hydrogen atom, alkyl group, alkenyl group, alkynyl group, aryl group or heterocyclic group; $R^{14}$ represents a substituent; $Z^1$ represents an oxygen atom, sulfur atom or —N($R^{15}$)—, in which $R^{15}$ represents a hydrogen atom, an alkyl group, alkenyl group, alkynyl group, aryl group, heterocyclic group or —N($R^{16}$) ($R^{17}$), in which $R^{16}$ and $R^{17}$ each represent a hydrogen atom, alkyl group, alkenyl group, alkynyl group, aryl group or heterocyclic group.

6. The photographic material of claim 1, wherein the component layer further contains a compound represented by formula (4):

$$A_1—\{(L_1)a—(B_1)m\}p—(L_2)n—DI \qquad \text{formula (4)}$$

wherein $A_1$ represents a group capable of releasing $\{(L_1)a—(B_1)m\}p—(L_2)n—DI$ upon reaction with an oxidation product of a developing agent; $L_1$ represents a linkage group which is capable of cleaving the bond between $L_1$ and $B_1$ after the cleavage of the bond between $A_1$ and $L_1$; $B_1$ represents a group capable of releasing $(L_2)n—DI$, through bond cleavage between $B_1$ and $L_2$ represented by formula (4), upon reaction with the oxidation product of the developing agent; $L_2$ represents a linkage group which is capable of releasing DI, through bond cleavage between $L_2$ and DI; DI represents a development inhibitor; a, m, n each are an integer of 0 or 1; and p is an integer of 0,1 or 2, provided that when p is 2, each of $(L_1)a—(B_1)m$ may be the same or different.

7. The photographic material of claim 1, wherein the component layer further contains a compound represented by formula (5):

formula (5)

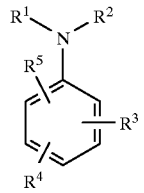

wherein $R^1$ and $R^2$ each represent a hydrogen atom, alkyl group, alkenyl group, alkynyl group, aryl group or heterocyclic group; and $R^3$, $R^4$ and $R^5$ each represents a substituent, provided that $R^1$ and $R^2$, $R^3$ and R4, or $R^4$ and $R^5$ may combine with each other to form a ring.

8. The photographic material of claim 1, wherein the component layers include a red-sensitive silver halide emulsion layer, a green-sensitive silver halide emulsion layer and a blue-sensitive silver halide emulsion layer, said green-sensitive silver halide emulsion layer containing said compound represented by formula (1).

9. The photographic material of claim 8, wherein said green-sensitive layer comprises tabular silver halide grains having an aspect ratio of not less than 1.5, and accounting for not less than 50% of the total projected area of silver halide grains contained in the green-sensitive layer.

10. The photographic material of claim 9, wherein said tabular grains comprises silver iodobromide or silver iodochlorobromide.

* * * * *